US009075367B2

(12) United States Patent
Mitsunobu

(10) Patent No.: US 9,075,367 B2
(45) Date of Patent: Jul. 7, 2015

(54) IMAGE FORMING APPARATUS

(71) Applicant: Oki Data Corporation, Tokyo (JP)

(72) Inventor: Hidetaka Mitsunobu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/499,761

(22) Filed: Sep. 29, 2014

(65) Prior Publication Data

US 2015/0093129 A1 Apr. 2, 2015

(30) Foreign Application Priority Data

Sep. 30, 2013 (JP) ..... 2013-202909

(51) Int. Cl.
*G03G 15/01* (2006.01)
*G03G 15/00* (2006.01)
*G03G 15/14* (2006.01)

(52) U.S. Cl.
CPC ..... *G03G 15/50* (2013.01); *G03G 15/14* (2013.01)

(58) Field of Classification Search
CPC ..... G03G 2215/0161; G03G 15/0131; G03G 15/5058; G03G 15/0194; G03G 15/0189
See application file for complete search history.

(56) References Cited

U.S. PATENT DOCUMENTS

| | | | | |
|---|---|---|---|---|
| 6,108,510 | A * | 8/2000 | Nakane | 399/303 |
| 2010/0165398 | A1* | 7/2010 | Watanabe | 358/1.15 |
| 2013/0164004 | A1* | 6/2013 | Ai | 399/40 |
| 2014/0119752 | A1* | 5/2014 | Zaretsky et al. | 399/40 |

FOREIGN PATENT DOCUMENTS

JP 2010-152209 A 7/2010

* cited by examiner

*Primary Examiner* — Walter L Lindsay, Jr.
*Assistant Examiner* — Frederick Wenderoth
(74) *Attorney, Agent, or Firm* — Muncy, Geissler, Olds & Lowe, P.C.

(57) ABSTRACT

An image forming apparatus includes a first image forming unit that uses a first toner for a first toner image and a second image forming unit that uses a second toner for a second toner image, and transfers, a controller that controls the first image forming unit and the second image forming unit, having two control modes, a first print mode in which the first toner image and the second toner image are continuously transferred to the transfer medium; and a second print mode in which the first toner image is transferred thereafter, the transfer medium, on which the first toner image is formed, is passed through the second image forming unit without the second image forming unit performing image transfer. The controller performs control in such a manner that an amount of the first toner in the first print mode is greater than that in the second print mode.

19 Claims, 12 Drawing Sheets

| Recording Medium | Print Mode |
|---|---|
| Regular Sheet | Print White Toner Image Below Color Toner Image : Tow-Pass Print |
| Transfer Sheet | Print White Toner Image Above Color Toner Image : One-Pass Print |

| | Voltage Settings | | | | | |
|---|---|---|---|---|---|---|
| | W1 (Two-Pass) | W2 (One-Pass) | Y | C | M | K |
| Charging Vol. CH (V) | -1000 | -1060 | -1200 | -1200 | -1200 | -1200 |
| Develop. Vol. DB (V) | -200 | -260 | -200 | -200 | -200 | -200 |
| Layer Formation and Supply Vol. SB (V) | -400 | -460 | -300 | -300 | -300 | -300 |
| Primary Transfer Vol. TR (V) | +4000 | +4000 | +4000 | +4000 | +4000 | +4000 |

| | Voltage Settings | | | | | | |
|---|---|---|---|---|---|---|---|
| | W1 (Two-Pass) | W2 (One-Pass) | W3 (One-Pass·POP) | Y | C | M | K |
| Charging Vol. CH (V) | -1000 | -1060 | -1060 | -1200 | -1200 | -1200 | -1200 |
| Develop. Vol. DB (V) | -200 | -260 | -260 | -200 | -200 | -200 | -200 |
| Layer Formation and Supply Vol. SB (V) | -400 | -460 | -500 | -300 | -300 | -300 | -300 |
| Primary Transfer Vol. TR (V) | +4000 | +4000 | +4000 | +4000 | +4000 | +4000 | +4000 |

IMAGE FORMING APPARATUS

CROSS REFERENCE

The present application is related to, claims priority from and incorporates by reference Japanese Patent Application No. 2013-202909, filed on Sep. 30, 2013.

TECHNICAL FIELD

The present invention relates to an image forming apparatus, such as a printer, a copying machine or a facsimile, that uses an electrophotographic method.

BACKGROUND

Conventionally, an image forming apparatus is known that, on a recording medium, forms a transparent toner image above (on a surface side of) or below (on a recording medium side of) a toner image (color toner image) that forms an image.

For example, an image forming apparatus disclosed in Japanese Patent Laid-Open Publication No. 2010-152209 (for example, see paragraphs [0040]-[0044]) forms a transparent toner image above a color toner image when a recording medium is a glossy sheet, and forms transparent toner images above and below a color toner image when a recording medium is a regular sheet.

In this image forming apparatus, when a transparent toner image is formed above a color toner image, a one-pass print is performed in which a transfer medium is carried only once along an image forming unit. On the other hand, when transparent toner images are formed above and below a color toner image, a two-pass print is performed in which a transfer medium is carried twice along the image forming unit.

However, in the above-described configuration, between the case where the one-pass print is performed and the case where the two-pass print is performed, a difference in an amount of the transparent toner that is transferred to the transfer medium occurs, and as a results, a difference in an amount of the transparent toner that is finally transferred to the recording medium also occurs, and thus there is a possibility that image quality is affected.

In view of the above problem, a purpose of the present invention is to provide an image forming apparatus that allows an amount of a toner (such as a white toner or a transparent toner) that is transferred to a recording medium to be nearly constant and image quality to be improved.

SUMMARY

An image forming apparatus disclosed in the application includes a first image forming unit that uses a first toner to form a first toner image and transfers the first toner image to a transfer medium that moves in a predetermined moving direction; a second image forming unit that is arranged on a downstream side from the first image forming unit in the movement direction of the transfer medium, uses a second toner to form a second toner image, and transfers the second toner image to the transfer medium; the second toner being characterized to be charged easier than the first toner is, a controller that controls the first image forming unit and the second image forming unit so that the first toner image and second toner image are layered on the transfer medium; the controller having two control modes, a first print mode in which the first toner image and the second toner image are continuously transferred to the transfer medium by the first image forming unit and the second image forming unit so that the second toner image is formed on the first toner image above the transfer medium; and a second print mode that includes an operation in which the first toner image is transferred to the transfer medium by the first image forming unit and thereafter, the transfer medium, on which the first toner image is formed, is passed through the second image forming unit without the second image forming unit performing image transfer, wherein the controller performs control in such a manner that an amount of the first toner that is transferred from the first image forming unit in the first print mode is greater than that in the second print mode.

In the present invention, the amount of the first toner that is transferred from the first image forming unit to the transfer medium in the first print mode is more than that in the second print mode. Therefore, even when a portion of the first toner that is transferred to the transfer medium attaches to the second image forming unit when the transfer medium passes through the second image forming unit (reverse transfer), a sufficient amount of the first toner can remain on the transfer medium. As a result, the amount of the first toner on the recording medium can be nearly constant and image quality can be improved.

DETAILED DESCRIPTION OF EMBODIMENTS

First Embodiment

<Configuration of Image Forming Apparatus>

Figure 1:
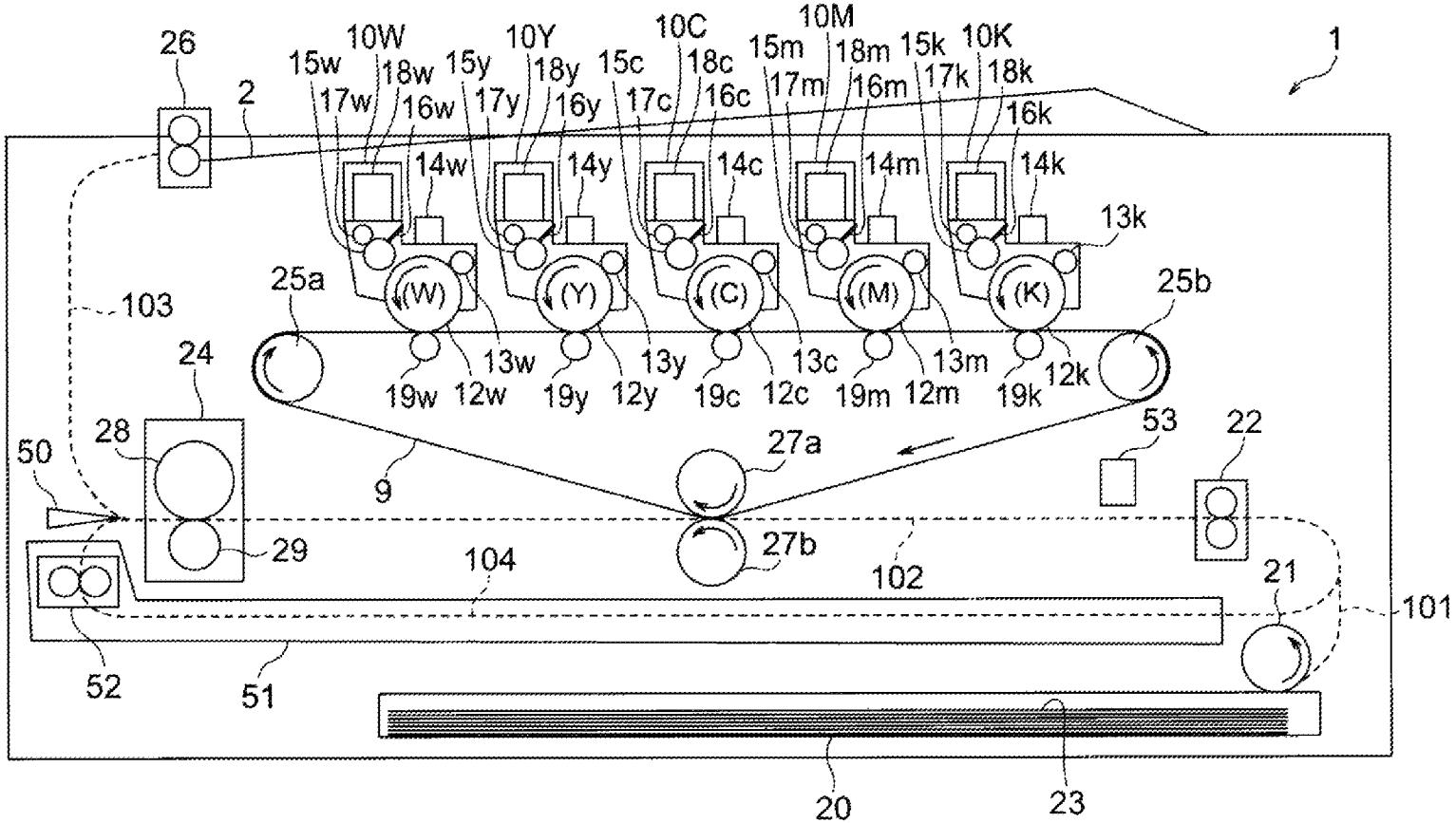
FIG. 1 illustrates a configuration of an image forming apparatus according to a first embodiment of the present invention.

FIG. 1 illustrates a configuration of an image forming apparatus according to a first embodiment of the present invention. Here, the image forming apparatus is described as an electrophotographic printer that forms an image using five kinds of toners including white, yellow, cyan, magenta and black toners.

An image forming apparatus 1 of the present embodiment is provided with five image drum units (hereinafter, referred to as ID units) 10W, 10Y, 10C, 10M, 10K as image forming units. The ID units 10W, 10Y, 10C, 10M, 10K are arranged in a row along a movement direction of an intermediate transfer belt 9 (to be described later) (here from left to right in FIG. 1).

The image forming apparatus 1 further has a sheet feeding cassette 20 (medium housing part) that houses a plurality of sheets of recording media (for example, print sheets) 23 in a loaded state, a sheet feeding roller 21 (medium feeding part) that feeds out one by one the recording medium 23 from the sheet feeding cassette 20, a feed carrying path 101 that guides the medium 23 that is fed out from the sheet feeding cassette 20, a carrying roller unit 22 (medium carrying part) that further carries the recording medium 23 that is carried along the feed carrying path 101, a carrying path 102 that guides the recording medium 23 that is carried by the carrying roller unit 22, and a medium sensor 53 (medium detection part) that detects passage of the recording medium 23.

The image forming apparatus 1 further has an intermediate transfer belt 9 (transfer medium) that is an endless belt arranged in a manner opposing an under side of the ID units 10W, 10Y, 10C, 10M, 10K. On an inner peripheral side of the intermediate transfer belt 9, primary transfer rollers 19*w*, 19*y*, 19*c*, 19*m*, 19*k* that primarily transfer toner images that are formed by the respective ID units 10W, 10Y, 10C, 10M, 10K to the intermediate transfer belt 9, a belt drive roller 25*a* that drives the intermediate transfer belt 9, a driven roller 25*b*, and a secondary transfer backup roller 27*a* are arranged.

On an outer peripheral side of the intermediate transfer belt 9, a secondary transfer roller 27*b* is arranged in a manner that the intermediate transfer belt 9 is sandwiched between the secondary transfer backup roller 27*a* and the secondary transfer roller 27*b*. By the secondary transfer backup roller 27*a* and the secondary transfer roller 27*b*, a secondary transfer part is formed that transfers a toner image from the intermediate transfer belt 9 to the recording medium 23.

The image forming apparatus 1 is further provided with a fuser unit 24 that fuses a toner image by applying heat and pressure to the recording medium 23 to which the toner image has been transferred by the secondary transfer part. The fuser unit 24 has a heat application roller 28 and a pressure application roller 29. The heat application roller 28 has thereinside a heat generation body such as a halogen lamp, and applies heat to the recording medium 23. The pressure application roller 29 applies pressure to the recording medium 23 by sandwiching the recording medium 23 between the heat application roller 28 and the pressure application roller 29.

The image forming apparatus 1 is further provided with a selector 50 (carrying path switching mechanism) that switches a carrying path of the recording medium 23 that is ejected from the fuser unit 24, an ejection carrying path 103, and a re-carrying path 104. The ejection carrying path 103 is a carrying path for ejecting the recording medium 23, on which a toner image is fused, to outside of the image forming apparatus 1. The re-carrying path 104 is a carrying path for carrying (re-carrying) the recording medium 23, on which a toner image is fused, to the carrying roller unit 22 without inverting a print side of the recording medium 23.

The image forming apparatus 1 is further provided with an ejection roller unit 26 (medium ejection part) that ejects the recording medium 23 that is carried thereto along the ejection carrying path 103 to outside of the apparatus, an ejection tray 2 on which the recording medium 23 that is ejected by the ejection roller unit 26 is placed, and a re-carrying unit 51 that carries the recording medium 23 along the re-carrying path 104 to the carrying roller unit 22. The re-carrying unit 51 has a re-carrying roller unit 52 that carries the recording medium 23 along the re-carrying path 104.

LED (light emitting diode) heads 14*w*, 14*y*, 14*c*, 14*m*, 14*k* as exposure part are arranged in a manner opposing the ID units 10W, 10Y, 10C, 10M, 10K. The LED heads 14*w*, 14*y*, 14*c*, 14*m*, 14*k* form electrostatic latent images that correspond to image data of white, yellow, cyan, magenta and black by irradiating photosensitive drums 12*w*, 12*y*, 12*c*, 12*m*, 12*k* (to be described later) of the ID units 10W, 10Y, 10C, 10M, 10K with light.

The ID units 10W, 10Y, 10C, 10M, 10K have the photosensitive drums 12*w*, 12*y*, 12*c*, 12*m*, 12*k* as image carriers, charging rollers 13*w*, 13*y*, 13*c*, 13*m*, 13*k* as charging members, development rollers 15*w*, 15*y*, 15*c*, 15*m*, 15*k* as developer carriers, supply rollers 17*w*, 17*y*, 17*c*, 17*m*, 17*k* as supply members, and layer forming blades 16*w*, 16*y*, 16*c*, 16*m*, 16*k* as layer forming members.

The photosensitive drum 12*w* is also referred to as a "first image carrier." The photosensitive drums 12*y*, 12*c*, 12*m*, 12*k* are also referred to as "second image carriers." The charging roller 13*w* is also referred to as a "first charging member." The charging rollers 13*y*, 13*c*, 13*m*, 13*k* are also referred to as "second charging members." The LED head 14*w* is also referred to as a "first exposure part." The LED heads 14*y*, 14*c*, 14*m*, 14*k* are also referred to as "second exposure part."

Further, the development roller 15*w* is also referred to as a "first developer carrier." The development rollers 15*y*, 15*c*, 15*m*, 15*k* are also referred to as "second developer carriers." The supply roller 17*w* is also referred to as a "first supply member." The supply rollers 17*y*, 17*c*, 17*m*, 17*k* are also referred to as "second supply members." The layer forming blade 16*w* is also referred to as a "first layer forming member." The layer forming blades 16*y*, 16*c*, 16*m*, 16*k* are also referred to as "second layer forming members."

The ID units 10W, 10Y, 10C, 10M, 10K further have toner tanks 18*w*, 18*y*, 18*c*, 18*m*, 18*k* attached as developer containers. The toner tanks 18*w*, 18*y*, 18*c*, 18*m*, 18*k* respectively contain white, yellow, cyan, magenta and black developers for image development. The developer may be a one-component developer composed of a toner or a two-component developer composed of a toner and a carrier.

The photosensitive drums 12*w*, 12*y*, 12*c*, 12*m*, 12*k* are formed by, for example, coating a photosensitive layer on a surface of a cylindrical conductive supporting body. The photosensitive layer is formed by sequentially laminating a blocking layer, a charge generation layer and a charge transportation layer on the surface of the conductive supporting body. Here, the charge transportation layer has a thickness of about 18 μm.

The charging rollers 13*w*, 13*y*, 13*c*, 13*m*, 13*k* have a configuration in which, for example, a semiconductive urethane rubber layer is provided around a metal shaft and a protective film layer of a urethane resin is used to cover around the semiconductive urethane rubber layer. A charging voltage (CH) is applied to each of the charging rollers 13*w*, 13*y*, 13*c*, 13*m*, 13*k*, and surfaces of the photosensitive drums 12*w*, 12*y*, 12*c*, 12*m*, 12*k* are uniformly charged.

The development rollers 15*w*, 15*y*, 15*c*, 15*m*, 15*k* have a configuration in which, for example, an elastic layer is provided around a metal shaft. The elastic layer is formed, for example, using a semiconductive urethane rubber having an Asker C hardness of 70 degree. A development voltage (DB) is applied to each of the development rollers 15*w*, 15*y*, 15*c*, 15*m*, 15*k*, and electrostatic latent images that are formed on the surfaces of the photosensitive drums 12*w*, 12*y*, 12*c*, 12*m*, 12*k* are developed.

The supply rollers 17*w*, 17*y*, 17*c*, 17*m*, 17*k* have a configuration in which, for example, a foam layer is provided around a metal shaft. The foam layer is formed using, for example, a silicone foam having an Asker F hardness of 50 degree. A supply voltage is applied to each of the supply rollers 17*w*, 17*y*, 17*c*, 17*m*, 17*k*, and developers (toners, or toners and carriers) are supplied to the development rollers 15*w*, 15*y*, 15*c*, 15*m*, 15*k*.

The layer forming blades 16*w*, 16*y*, 16*c*, 16*m*, 16*k* have a configuration in which, for example, a substantially rectangular metal member is bent in a direction away from a circumferential surface of a respective one of the development rollers 15*w*, 15*y*, 15*c*, 15*m*, 15*k*, and a bent portion is in contact with a surface of the respective one of the development rollers 15*w*, 15*y*, 15*c*, 15*m*, 15*k*. A layer formation voltage is applied to each of the layer forming blades 16*w*, 16*y*, 16*c*, 16*m*, 16*k*, and a thickness of a developer layer on each of the development rollers 15*w*, 15*y*, 15*c*, 15*m*, 15*k* is regulated. In the present embodiment, the layer formation voltage and the supply voltage are set to be the same and are referred to as a layer formation and supply voltage (SB).

The intermediate transfer belt 9 is a seamless endless belt that is formed using plastic film. The intermediate transfer belt 9 has a two-layer structure including a high resistance layer on the outer peripheral side that is formed using a material having a high electrical resistance and a conductive layer (low resistance layer) on the inner peripheral side that is formed using a material having a low electrical resistance. The intermediate transfer belt 9 is stretched over the belt drive roller 25*a*, the belt driven roller 25*b* and the secondary transfer backup roller 27*a* as support members, and an outer peripheral surface (the high resistance layer) of the intermediate transfer belt 9 is in contact with the surfaces of the photosensitive drums 12*w*, 12*y*, 12*c*, 12*m*, 12*k*.

The high resistance layer of the intermediate transfer belt 9 is formed, for example, by adding carbon to polyamide-imide so as to have a volume resistivity of $10^{11}$-$10^{13}$ Ω·cm. The conductive layer of the intermediate transfer belt 9 is formed, for example, by rolling an aluminum thin film as a conductive member and bonding or depositing the rolled aluminum thin film onto the high resistance layer so as to have a volume resistivity of $10^{14}$ Ω·cm or less.

The primary transfer rollers 19*w*, 19*y*, 19*c*, 19*m*, 19*k* have a configuration in which, for example, a foamed elastic layer is provided around a metal shaft. The elastic layer is formed, for example, using an elastic foam rubber having a medium electrical resistance. A primary transfer voltage (TR) is applied to each of the primary transfer rollers 19*w*, 19*y*, 19*c*, 19*m*, 19*k*, and toner images on the photosensitive drums 12*w*, 12*y*, 12*c*, 12*m*, 12*k* are transferred (primarily transferred) to the intermediate transfer belt 9.

The secondary transfer roller 27*b* has a configuration in which a foamed elastic layer is provided around a metal shaft and a covering layer covers around the elastic layer. The elastic layer is formed, for example, using an elastic foam rubber. The covering layer is formed, for example, using a resin tube. A secondary transfer voltage is applied to the secondary transfer roller 27*b*, and the toner images on the intermediate transfer belt 9 are transferred (secondarily transferred) to the recording medium 23.

The image forming apparatus 1 is further provided with an up-down mechanism 70 (FIGS. 2A-2C) that allows the respective photosensitive drums 12*w*, 12*y*, 12*c*, 12*m*, 12*k* of the ID units 10W, 10Y, 10C, 10M, 10K to be brought in contact with or to be spaced apart from the intermediate transfer belt 9.

Figure 2A:
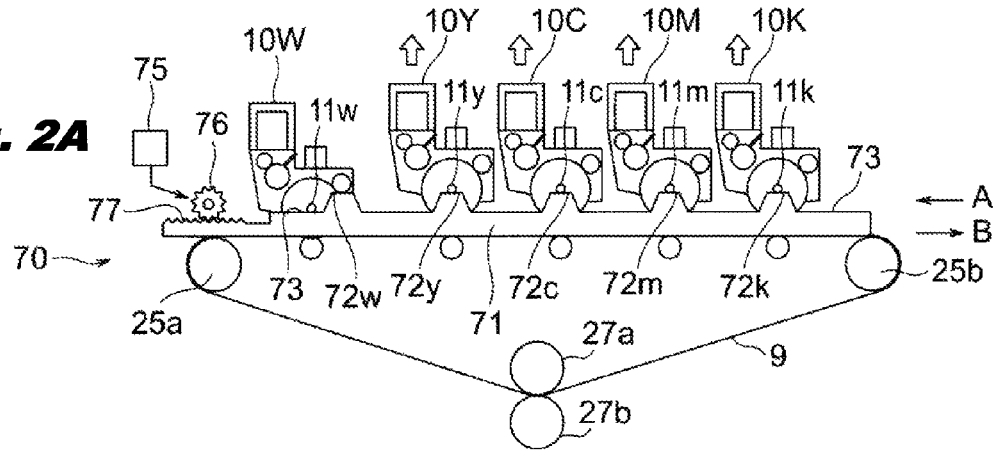
FIGS. 2A-2C illustrate schematic diagrams illustrating a basic configuration and operations of an up-down mechanism according to the first embodiment.
Figure 2B:
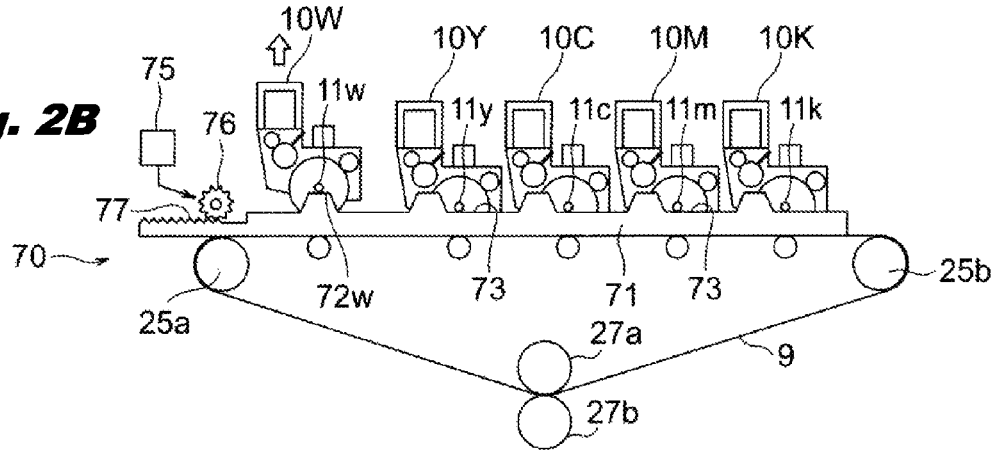
Figure 2C:
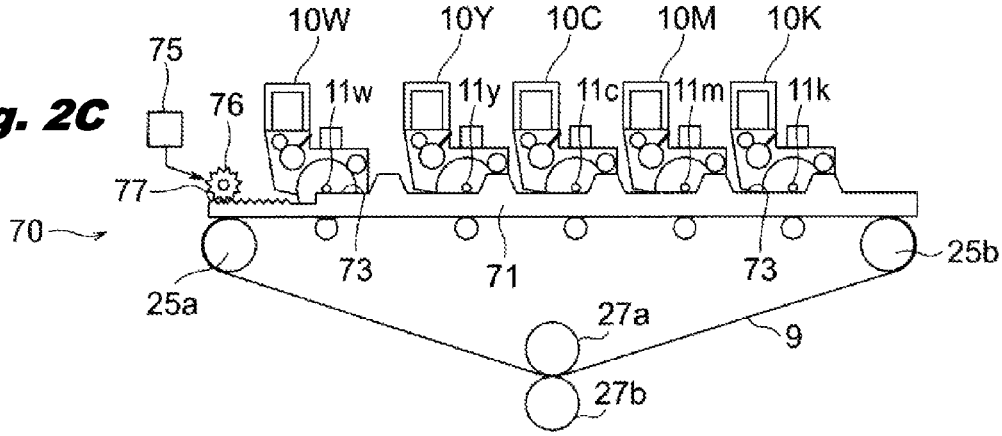

FIGS. 2A-2C illustrate schematic diagrams illustrating a basic configuration and operations of the up-down mechanism 70. The up-down mechanism 70 (contact and separation mechanism) has an up-down lever 71 that extends along an arrangement direction of the ID units 10W, 10Y, 10C, 10M, 10K.

The up-down lever 71 is positioned on one side in an axial direction of the photosensitive drums (a direction perpendicular to the paper surface) with respect to the ID units 10W, 10Y, 10C, 10M, 10K. In FIGS. 2A-2C, for convenience of illustration, the up-down lever 71 is illustrated in a manner overlapping with the ID units 10W, 10Y, 10C, 10M, 10K.

As illustrated by arrows A and B in FIG. 2A, the up-down lever 71 is configured to be movable in the arrangement direction of the ID units 10W, 10Y, 10C, 10M, 10K. Further, on an end part (here, a left end part) of the up-down lever 71, a rack 77 is formed. A pinion gear 76 that is rotated by an up-down motor 75 engages with the rack 77. Due to rotation of the up-down motor 75, the up-down lever 71 moves in directions indicated by the arrows A and B (here, leftward and rightward directions).

The up-down lever 71 further has convex-shaped up position regulation parts 72*w*, 72*y*, 72*c*, 72*m*, 72*k* that push up contact parts 11*w*, 11*y*, 11*c*, 11*m*, 11*k* that are respectively provided on the ID units 10W, 10Y, 10C, 10M, 10K to up positions (retreat positions), and a down position regulation part 73 that holds the ID units 10W, 10Y, 10C, 10M, 10K at a down position (transferable position).

Here, a top surface (flat surface) of a portion of the up-down lever 71 excluding the convex portions, which configure the up position regulation parts 72*w*, 72*y*, 72*c*, 72*m*, 72*k*, and the rack 77 forms the down position regulation part 73. Further, two side surfaces of each of the convex portions that configure the up position regulation parts 72*w*, 72*y*, 72*c*, 72*m*, 72*k* are inclined surfaces.

When the up-down lever 71 is in a position illustrated in FIG. 2A, the up position regulation parts 72*y*, 72*c*, 72*m*, 72*k* are in positions where the contact parts 11*y*, 11 *c*, 11*m*, 11*k* of the yellow, cyan, magenta and black ID units 10Y, 10C, 10M, 10K are lifted. On the other hand, the up position regulation part 72*w* is not in a position where the contact part 11*w* of the white ID unit 10*w* is lifted. The contact part 11*w* of the ID unit 10*w* is held on the down position regulation part 73.

That is, in a state illustrated in FIG. 2A, the yellow, cyan, magenta and black ID units 10Y, 10C, 10M, 10K are in up positions, that is, positions (retreat positions) spaced apart upwardly from the intermediate transfer belt 9, and the white ID unit 10*w* is in a down position, that is, a position (transferable position) in contact with the intermediate transfer belt 9.

On the other hand, when the up-down lever 71 moves from the state of FIG. 2A in the arrow A direction, as illustrated in FIG. 2B, the up position regulation part 72*w* reaches a position where the contact part 11*w* of the white ID unit 10*w* is lifted. In this case, the up position regulation parts 72*y*, 72*c*, 72*m*, 72*k* are away from the positions where the contact parts 11*y*, 11*c*, 11*m*, 11*k* of the yellow, cyan, magenta and black ID units 10Y, 10C, 10M, 10K are lifted. Therefore, the contact parts 11*y*, 11*c*, 11*m*, 11*k* of the ID units 10Y, 10C, 10M, 10K are held on the down position regulation part 73.

That is, in a state illustrated in FIG. 2B, the white ID unit 10*w* is in an up position, that is, a position (retreat position) spaced apart from the intermediate transfer belt 9, and the yellow, cyan, magenta and black ID units 10Y, 10C, 10M, 10K are in down positions, that is, positions (transferable positions) in contact with the intermediate transfer belt 9.

Further, when the up-down lever 71 moves from the state of FIG. 2A in the arrow B direction, as illustrated in FIG. 2C, the up position regulation parts 72*w*, 72*y*, 72*c*, 72*m*, 72*k* are away from the positions where the contact parts 11*w*, 11*y*, 11*c*, 11*m*, 11*k* of the white, yellow, cyan, magenta and black ID units 10W, 10Y, 10C, 10M, 10K are lifted. Therefore, the contact part 11*w*, 11*y*, 11*c*, 11*m*, 11*k* of the ID units 10W, 10Y, 10C, 10M, 10K are all held on the down position regulation part 73.

That is, in a state illustrated in FIG. 2C, the white, yellow, cyan, magenta and black ID units 10W, 10Y, 10C, 10M, 10K are all in the down positions, that is, the positions (transferable positions) in contact with the intermediate transfer belt 9.

As just described, the up-down mechanism 70 allows switching between a first state (FIG. 2A) in which the yellow, cyan, magenta and black ID units 10Y, 10C, 10M, 10K are spaced apart from the intermediate transfer belt 9 and the white ID unit 10*w* is in contact with the intermediate transfer belt 9, a second state (FIG. 2B) in which the yellow, cyan, magenta and black ID units 10Y, 10C, 10M, 10K are in contact with the intermediate transfer belt 9 and the white ID unit 10*w* is spaced apart from the intermediate transfer belt 9, and a third state (FIG. 2C) in which all the ID units 10W, 10Y, 10C, 10M, 10K are in contact with the intermediate transfer belt 9.

The white toner is also referred to as a "first toner." Further, a white toner image that the ID unit 10W transfers onto the intermediate transfer belt 9 is also referred to as a "first toner image" (or coating toner image). The ID unit 10W is also referred to as a "first image forming unit."

On the other hand, the color (yellow, cyan, magenta and black) toners are also referred to as "second toners." Further, color toner images that the ID units 10Y, 10C, 10M, 10K transfer onto the intermediate transfer belt 9 are also referred to as "second toner images" (or image-forming toner images). The ID units 10Y, 10C, 10M, 10K are also referred to as "second image forming units."

Next, the toners are described. The white, yellow, cyan, magenta and black toners are configured to contain a polyester resin, a colorant, a charge control agent and a release agent, and further an external additive such as hydrophobic silica is added thereto. Here, toners manufactured using a pulverizing method are used, but it is also possible to use toners manufactured using a commonly known method such as a polymerization method.

A white colorant is made of an inorganic material based (more specifically, metal based) pigment such as a titanium dioxide. It is preferable that the white colorant is opaque. On the other hand, yellow, cyan, magenta and black colorants are made of organic material based pigments. For example, a pigment yellow is used as the yellow colorant; a pigment cyan is used as the cyan colorant; a pigment magenta is used as the magenta colorant; and a carbon black is used as the black colorant. It is preferable that these yellow, cyan, magenta and black colorants are transparent to some extent.

The white toner has an average particle size of for example, 7.0 μm. The yellow, cyan and magenta toners have an average particle size of, for example, 5.6 μm. The black toner has an average particle size of, for example, 5.7 μm.

Further, the white, yellow, cyan, magenta and black toners have a circularity of, for example, 0.950-0.955. The circularity is an indicator of a degree of irregularity of particles. When the circularity is 1.000, the particles are perfectly spherical. As the circularity becomes less than 1.000, shapes of the particles become more irregular.

The circularity of a toner is measured based on the following formula (1) using a "flow type particle image analyzer FPIA-3000" (manufactured by Sysmex Corporation).

$$\text{circularity}=L1/L2 \quad (1)$$

Here, L1 is a boundary length of a circle having an area that is the same as an area of a projected image of a particle, and L2 is a boundary length of the projected image of the particle. The measured value of the circularity is obtained by dividing a sum of circularities of all measured particles by the number of the all measured particles.

Further, the white toner has a charge amount of for example, −24 μC/g. The yellow toner has a charge amount of for example, −49 μC/g. The cyan toner has a charge amount of for example, −49 μC/g. The magenta toner has a charge amount of for example, −44 μC/g. The black toner has a charge amount of, for example, −55 μC/g.

Figure 3:
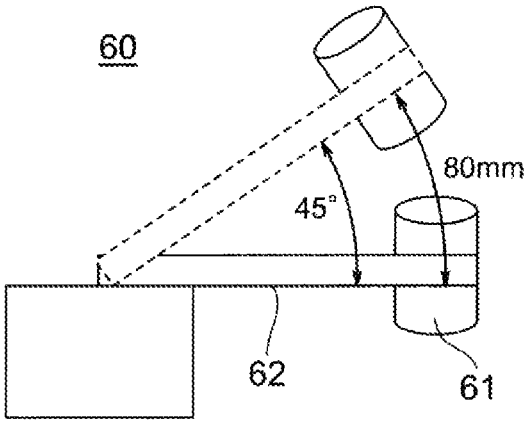
FIG. 3 illustrates a schematic diagram for describing a measurement method of a charge amount of a toner.

The charge amount (blow off charge amount) of a toner is measured by stirring by shaking the toner and a carrier. Here, with respect to 0.5 g of the toner, 9.5 g of a ferrite carrier "F-60" manufactured by Powder-Tech Co., Ltd. is mixed. A shaker named "model YS-LD" manufactured by Yayoi Co., Ltd. is used for the shaking. As schematically illustrated in FIG. 3, the mixture of the toner and the carrier is contained in a container 61 attached to a front end of an arm 62 of a shaker 60. A shaking frequency is 200 times/minute; a shaking angle is 45°; and a shaking amplitude is 800 mm Shaking time is 30 minutes.

After the stirring, a powder charge amount measurement device "TYPE TB-203" manufactured by Kyocera Corporation is used to perform suction for 10 seconds at a blow pressure of 7 kPa and a suction pressure of 4.5 kPa. From a charge amount and a suction amount after 10 seconds, a charge amount per unit weight, Q/M (unit: μC/g), of the toner particles is calculated.

<Control System of Image Forming Apparatus>

Figure 4:
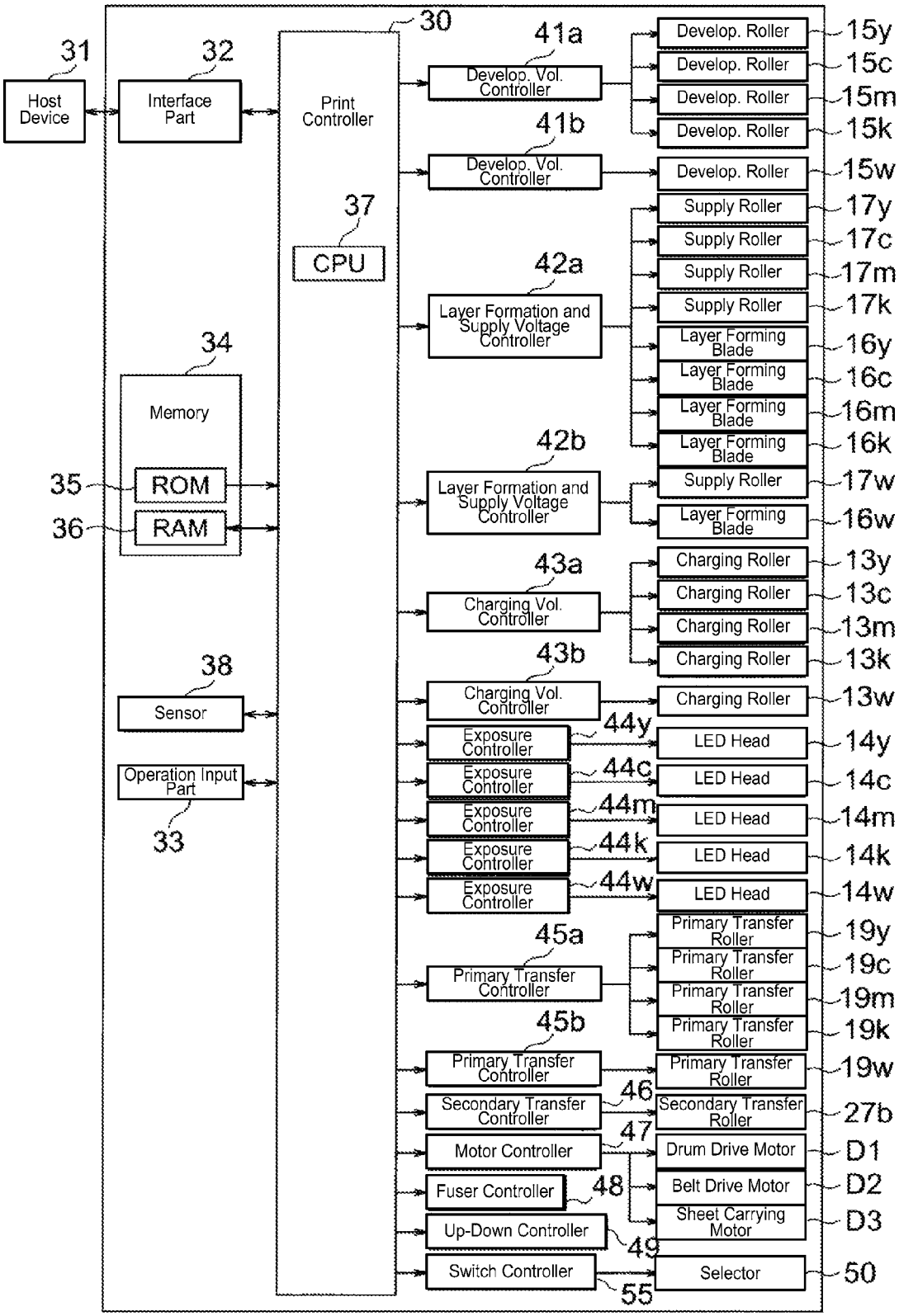
FIG. 4 illustrates a block diagram illustrating a control system of the image forming apparatus according to the first embodiment.

Next, a control system of the image forming apparatus 1 is described. FIG. 4 illustrates a block diagram illustrating the control system of the image forming apparatus 1. As illustrated in FIG. 4, the image forming apparatus 1 is provided with a print controller (controller) 30 that is responsible for controlling overall operation of the image forming apparatus 1. The print controller 30 has a CPU 37.

An interface part 32 that receives a command and print data from a host device 31 (such as a personal computer) as an information input part, an operation input part 33 that receives operation input from a user, a memory 34 as a storing part, and various sensors 38 are connected to the print controller 30. The memory 34 has a ROM 35 and RAM 36. A print operation program, a print mode setting screen 80 (FIG. 5A) (to be described later), a recording medium/print mode correspondence table (FIG. 5B) (to be described later), a voltage setting table (FIG. 6) (to be described later) and the like are stored in the ROM 35. The various sensors 38 include a sensor such as the medium sensor 53 that detects passage of the recording medium 23, a temperature and humidity sensor that detects temperature and humidity of the image forming apparatus 1, and the like.

Further, development voltage controllers 41*a*, 41*b*, layer formation and supply voltage controllers 42*a*, 42*b*, charging voltage controllers 43*a*, 43*b*, exposure controllers 44*w*, 44*y*, 44*c*, 44*m*, 44*k*, primary transfer controllers 45*a*, 45*b*, a secondary transfer controller 46, a motor controller 47, a fuser controller 48, an up-down controller 49, and a switch controller 55 are connected to the print controller 30.

The development voltage controller 41*a* controls the development voltage (DB) that is applied to the yellow, cyan, magenta and black development rollers 15*y*, 15*c*, 15*m*, 15*k*. The development voltage controller 41*b* controls the development voltage (DB) that is applied to the white development roller 15*w*.

The layer formation and supply voltage controller 42*a* controls the layer formation and supply voltage (SB) that is applied to the yellow, cyan, magenta and black layer forming blades 16*y*, 16*c*, 16*m*, 16*k* and the supply rollers 17*y*, 17*c*, 17*m*, 17*k*. The layer formation and supply voltage controller 42*b* controls the layer formation and supply voltage (SB) that is applied to the white layer forming blade 16*w* and the supply roller 17*w*.

The charging voltage controller 43*a* controls the charging voltage (CH) that is applied to the yellow, cyan, magenta and black charging rollers 13*y*, 13*c*, 13*m*, 13*k*. The charging voltage controller 43*b* controls the charging voltage (CH) that is applied to the white charging roller 13*w*.

The exposure controller 44*w*, 44*y*, 44*c*, 44*m*, 44*k* respectively perform drive controls (light emission controls) of the white, yellow, cyan, magenta and black LED heads 14*w*, 14*y*, 14*c*, 14*m*, 14*k*.

The primary transfer controller 45*a* controls the transfer voltage (TR) that is applied to the yellow, cyan, magenta and black primary transfer rollers 19*y*, 19*c*, 19*m*, 19*k*. The primary transfer controller 45*b* controls the transfer voltage (TR) that is applied to the white primary transfer roller 19*w*. The secondary transfer controller 46 controls the secondary transfer voltage that is applied to the secondary transfer roller 27*b*.

The motor controller 47 drive-controls a drum drive motor D1, a belt drive motor D2 and a sheet carrying motor D3. The drum drive motor D1 rotationally drives the photosensitive drums 12*w*, 12*y*, 12*c*, 12*m*, 12*k*. The belt drive motor D2 rotationally drives the belt drive roller 25*a* that drives the intermediate transfer belt 9.

A plurality of motors for carrying the recording medium 23 are collectively illustrated in FIG. 4 as the sheet carrying motor D3. Specifically, the sheet carrying motor D3 includes a sheet feeding motor that rotationally drives the sheet feeding roller 21, a carrying motor that rotationally drives the carrying roller unit 22, a secondary transfer motor that rotationally drives the secondary transfer roller 27*b*, a fuser motor that rotationally drives the pressure application roller 29 of the fuser unit 24, a re-carrying motor that rotationally drives the re-carrying roller 52, and an ejection motor that rotationally drives the ejection roller unit 26; and these motors are respectively controlled by the motor controller 47.

The photosensitive drums 12*w*, 12*y*, 12*c*, 12*m*, 12*k* are rotated by the drum drive motor D1 in a counterclockwise direction in FIG. 1. Further, gears are attached to end parts of the shafts of the respective photosensitive drums 12*w*, 12*y*, 12*c*, 12*m*, 12*k*, development rollers 15*w*, 15*y*, 15*c*, 15*m*, 15*k* and supply rollers 17*w*, 17*y*, 17*c*, 17*m*, 17*k*, and the rotations of the photosensitive drums 12*w*, 12*y*, 12*c*, 12*m*, 12*k* are transmitted to the development rollers 15*w*, 15*y*, 15*c*, 15*m*, 15*k* and the supply rollers 17*w*, 17*y*, 17*c*, 17*m*, 17*k*.

The fuser controller 48 performs heat application control of a heater of the heat application roller 28 based on a detection temperature of a thermistor that is provided in the fuser unit 24 and by referring to a temperature setting table.

The up-down controller 49 performs control to cause the ID units 10W, 10Y, 10C, 10M, 10K to be brought into contact with or to be spaced apart from the intermediate transfer belt 9 by causing the up-down lever 71 of the up-down mechanism 70 that is illustrated in FIG. 2A to move in the arrow A direction or the arrow B direction.

The switch controller 55 switches a position of the selector 50 and guides the recording medium 23 to one of the ejection carrying path 103 and the re-carrying path 104.

As the recording medium 23, for example, a transfer sheet or a colored regular sheet is used. The transfer sheet is a medium for transferring an image to a T-shirt or the like. After a toner image is fused on a transfer sheet using the image forming apparatus 1, by superimposing the transfer sheet on a T-shirt or the like and applying heat of an iron or the like thereto, the toner image is transferred to the T-shirt or the like. Further, the colored regular sheet is a regular sheet of a color other than white, for example, a regular sheet of black, blue or red.

Figures 5A, 5B, 6:
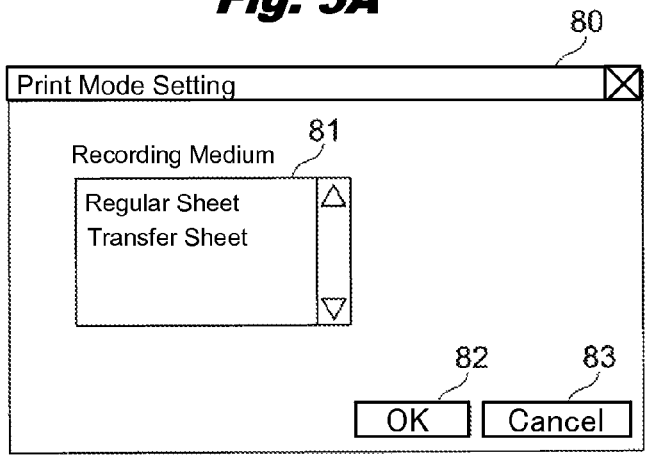
FIG. 5A illustrates a schematic diagram of a print mode setting screen of the image forming apparatus according to the first embodiment.
FIG. 5B illustrates a recording medium/print mode correspondence table.
FIG. 6 illustrates a voltage setting table which is a list of setting values of charging voltages, development voltages, supply voltages and primary transfer voltages of respective ID units according to the first embodiment.

FIG. 5A illustrates a schematic diagram illustrating the print mode setting screen 80 of the image forming apparatus 1. FIG. 5B illustrates a correspondence table (recording medium/print mode correspondence table) that associates a type of the recording medium 23 with a print mode. The print mode setting screen 80 illustrated in FIG. 5A and the recording medium/print mode correspondence table illustrated in FIG. 5B are stored in the ROM 35 (FIG. 4).

The print mode setting screen 80 has a medium list 81 (medium selection part) from which a user selects a recording medium to use, an OK button 82 for confirming and storing a setting selected using the medium list 81, and a cancel button 83 for canceling a setting selected using the medium list 81. From the medium list 81, one of "regular sheet" and "transfer sheet" can be selected.

In the present embodiment, the print mode is determined based on the type of the recording medium 23 that is used in the image forming apparatus 1. That is, as illustrated in the recording medium/print mode correspondence table of FIG. 5B, in a case where the regular sheet is used as the recording medium 23, a print mode (two-pass print, to be described later) is performed in which a white toner image is formed below a color toner image (on the recording medium 23 side). In contrast, in a case where the transfer sheet is used as the recording medium 23, a print mode (one-pass print, which will be described later) is performed in which a white toner image is formed above a color toner image (on an opposite side of the recording medium 23).

In the case where the regular sheet is used, the reason that the white toner image is formed below the color toner image is that, by using the white toner image as a base, influence of a color of the regular sheet is eliminated and an original color of the color toner image is reproduced.

Further, in the case where the transfer sheet is used, the reason that the white toner image is formed above the color toner image is that, in a state in which the toner image is transferred from the transfer sheet to a T-shirt or the like, the white toner image becomes a base.

FIG. 6 illustrates a list (voltage setting table) of setting values of the charging voltages CH, the development voltages DB, the layer formation and supply voltages SB and the primary transfer voltages TR of the respective white, yellow, cyan, magenta and black ID units 10W, 10Y, 10C, 10M, 10K. In the present embodiment, two voltage settings W1, W2 are available for the white ID unit 10W. The voltage setting table is stored in the ROM 35.

<Operation of Image Forming Apparatus>

Figure 7:
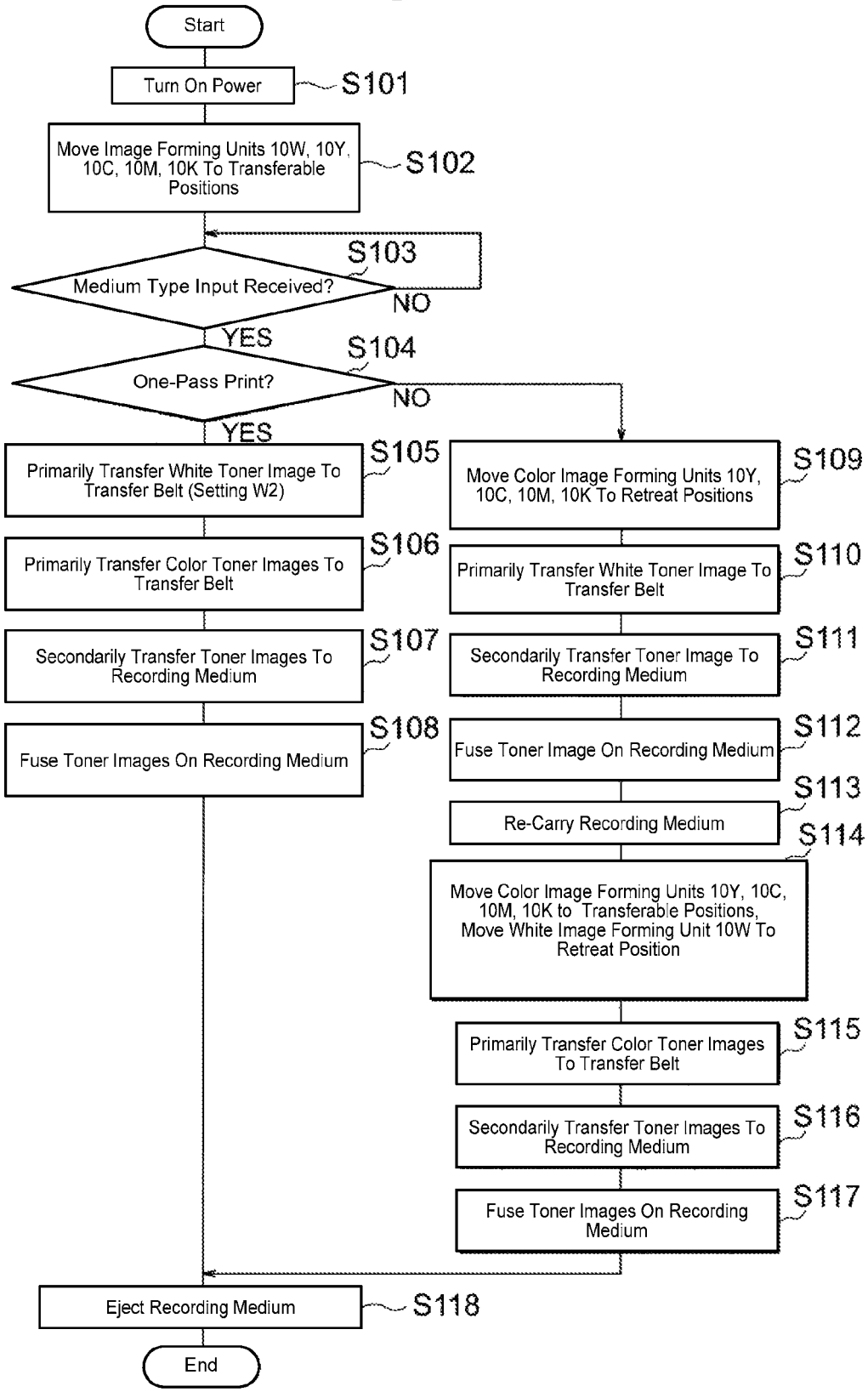
FIG. 7 illustrates a flow diagram illustrating operations of the image forming apparatus according to the first embodiment.
Figure 8A:
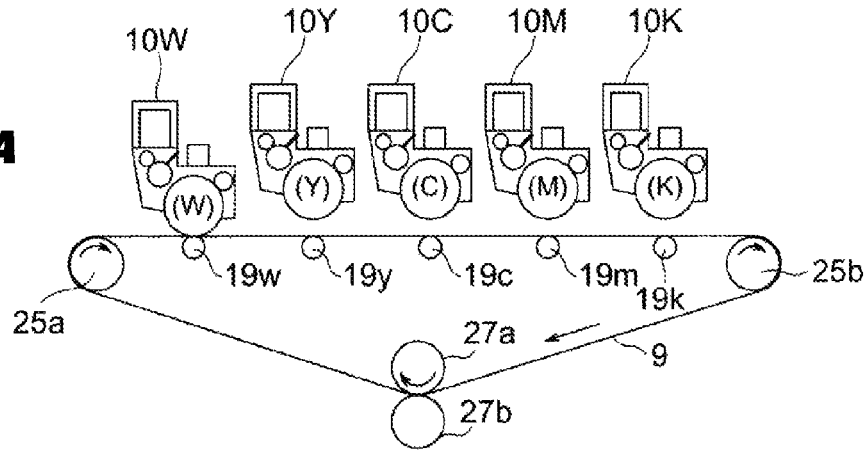
FIGS. 8A-8C illustrate schematic diagrams illustrating positional relations between the respective ID units and an intermediate transfer belt in the first embodiment.
Figure 8B:
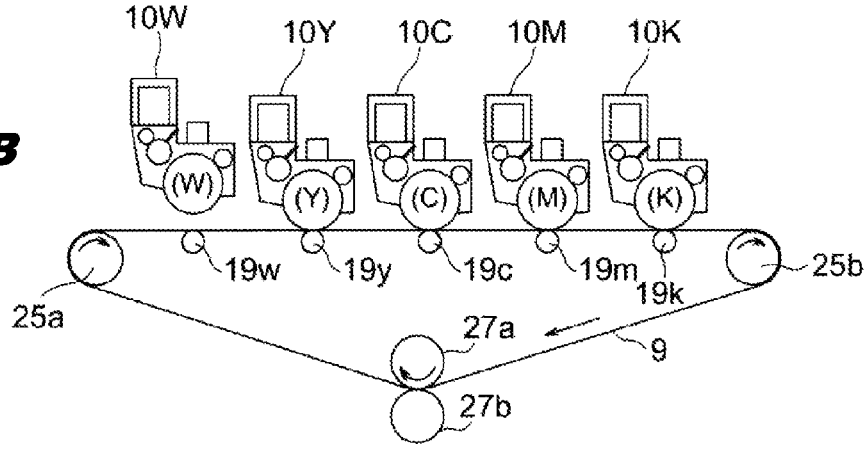
Figure 8C:
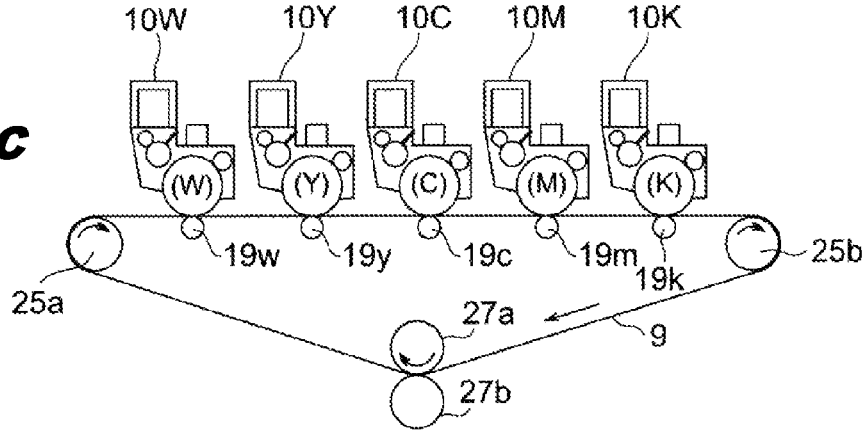

FIG. 7 illustrates a flow diagram illustrating operations of the image forming apparatus 1 of the present embodiment. First, the case where the transfer sheet is used as the recording medium 23 is described. FIGS. 8A-8C illustrate positional relations between the ID units 10W, 10Y, 10C, 10M, 10K and the intermediate transfer belt 9 and respectively correspond to the above-described FIGS. 2A-2C.

When the image forming apparatus 1 is started up (S101), the print controller 30 drives via the up-down controller 49 the up-down mechanism 70, holds the ID units 10W, 10Y, 10C, 10M, 10K in the position in contact with the intermediate transfer belt 9 as illustrated in FIG. 8C, and enters a standby state, that is a standby mode (S102).

Next, a user brings up the print mode setting screen 80 (FIG. 5A) that is stored in the ROM 35 from the host device 31 such as a personal computer. Here, it is assumed that the user selects the "transfer sheet" from the medium list 81 of the print mode setting screen 80, confirms the setting using the OK button 82, and stores the setting result (S103).

When the recording medium 23 is selected at S103, the print controller 30 reads out the recording medium/print mode correspondence table of FIG. 5B from the ROM 35, and determines the print mode based on the type (transfer sheet or regular sheet) of the recording medium 23 that the user selected (S104).

That is, when the transfer sheet is selected at S103, the print controller 30 selects the one-pass print (first print mode) in which, on the recording medium 23, a white toner image is formed above the color toner image (YES at S104). Further, when the regular sheet is selected at S103, the print controller 30 selects the two-pass print (second print mode) in which a white toner image is formed below a color toner image (NO at S104).

Here, since the user selects the transfer sheet, the print controller 30 selects the one-pass print, in which a white toner image is formed above a color toner image (YES at S104), and proceeds to S105.

Then, while the ID units 10W, 10Y, 10C, 10M, 10K are held in the state of FIG. 8C, on the intermediate transfer belt 9, white, yellow, cyan, magenta and black toner images are sequentially formed, and are transferred to the intermediate transfer belt 9.

That is, first, at S105, a white toner image is formed by the ID unit 10W and is transferred to the intermediate transfer belt 9. Specifically, the belt drive roller 25*a* is rotationally driven by the belt drive motor D2 and the intermediate transfer belt 9 is driven at a speed of 46 mm/s so that a print speed for the transfer sheet is 10 PPM (Page Per Minutes).

The print controller 30 further drives the drum drive motor D1 to rotate the photosensitive drum 12*w*, the development roller 15*w* and the supply roller 17*w*. The charging roller 13*w* rotates following the rotation of the photosensitive drum 12*w*.

The print controller 30 further reads out from the ROM 35 the voltage setting W2 for one-pass print that is illustrated in FIG. 6, and instructs the charging voltage controller 43*b*, the development voltage controller 41*b*, the layer formation and the supply voltage controller 42*b* and the primary transfer controller 46, of the ID unit 10W, regarding respective set voltages.

The charging voltage CH of −1060 V is applied to the charging roller 13*w* by the charging voltage controller 43*b*. The charging roller 13*w* rotates while in contact with the photosensitive drum 12*w* and uniformly charges the surface of the photosensitive drum 12*w*.

When the surface of the photosensitive drum 12*w* is charged, the print controller 30, via the exposure controller 44*w*, causes the LED 14*w* to radiate light and, on the surface of the photosensitive drum 12*w*, an electrostatic latent image based on white image data is formed.

The development voltage DB of −260 V is applied to the development roller 15*w* by the development voltage controller 41*b*. The layer formation and supply voltage SB of −460 V is applied to each of the layer forming blade 16*w* and the supply roller 17*w* by the layer formation and supply voltage controller 42*b*. The supply roller 17*w* supplies toner to the surface of the development roller 15*w*. The toner supplied on the surface of the development roller 15*w* receives a shear force due to passing through the layer forming blade 16*w*, and a layer thickness of the toner is regulated and a toner layer having a uniform thickness is formed. The toner on the development roller 15*w* attaches the electrostatic latent image on the photosensitive drum 12*w* and thereby the electrostatic latent image is developed.

The primary transfer voltage TR of +4 kV is applied to the primary transfer roller 19*w* by the primary transfer controller 45*b*. The white toner image that is formed on the surface of the photosensitive drum 12*w* is transferred to the surface of the intermediate transfer belt 9 by the primary transfer voltage. In this way, the white toner image is transferred to the intermediate transfer belt 9.

The intermediate transfer belt 9 further moves due to the rotation of the drive roller 25*a*, and the toner image on the intermediate transfer belt 9 moves to a downstream side.

At subsequent S106, the ID units 10Y, 10C, 10M, 10K sequentially form yellow, cyan, magenta and black toner images and transfer the toner images to the intermediate transfer belt 9.

The formation of the toner images by the ID units 10Y, 10C, 10M, 10K is substantially the same as the formation of the white toner image by the ID unit 10W. However, voltages of the respective rollers are set based on settings Y, C, M, K in the voltage setting table of FIG. 6. That is, the charging voltage CH of −1200 V is applied to each of the charging rollers 13*y*, 13*c*, 13*m*, 13*k* by the charging voltage controller 43*a*, and the development voltage DB of −200 V is applied to each of the development rollers 15*y*, 15*c*, 15*m*, 15*k* by the development voltage controller 41*a*. Further, the layer formation and supply voltage SB of −300 V is applied to each of the layer forming blades 16*y*, 16*c*, 16*m*, 16*k* and the supply rollers 17*y*, 17*c*, 17*m*, 17*k* by the layer formation and supply voltage controller 42*b*.

Rotation speeds of the intermediate belt drive motor D2 and the drum drive motor D1 are the same as when the white toner image is formed by the ID unit 10W. Further, the primary transfer voltage TR of +4 kV is applied to each of the primary transfer rollers 19*y*, 19*c*, 19*m*, 19*k* by the primary transfer controller 45*a*. As a result, the yellow, cyan, magenta and black toner images are further transferred to the intermediate transfer belt 9 to which the white toner image has already been transferred.

In this way, when the white, yellow, cyan, magenta and black toner images are formed on the intermediate transfer belt 9, the belt drive roller 25*a* further rotates and the intermediate transfer belt 9 further moves so that the toner images reaches the secondary transfer part (the secondary transfer backup roller 27*a* and the secondary transfer roller 27*b*). The secondary transfer voltage of +4 kV is applied to the secondary transfer roller 27*b* by the secondary transfer controller 46.

Further, using the timing at which the medium sensor 53 detects the passage of a leading edge of the recording medium 23 as a reference, the print controller 30 controls the carrying of the recording medium 23 by the carrying roller unit 22 and controls the drive motor (belt drive motor) D2 and the sheet carrying motor D3 in such a manner that the timing at which the recording medium 23 reaches the secondary transfer part is the same as the timing at which the toner images on the intermediate transfer belt 9 reaches the secondary transfer part.

Then, when the recording medium 23 passes through the secondary transfer part, the toner images on the intermediate transfer belt 9 are transferred to the recording medium 23 (S107).

As described above, the white, yellow, cyan, magenta and black toner images are laminated in this order on the intermediate transfer belt 9. Therefore, at the secondary transfer part, when the toner images are transferred from the intermediate transfer belt 9 to the recording medium 23, the black, magenta, cyan, yellow and white toner image are sequentially laminated on the recording medium 23.

Then, the recording medium 23 to which the toner images have been transferred is carried to the fuser unit 24 due to the rotation of the secondary transfer roller 27*b*. The heat application roller 28 of the fuser unit 24 is heated to 160° C. in advance by the fuser controller 48 based on the temperature setting table. The recording medium 23 is heated and pressed by being sandwiched by the heat application roller 28 and the pressure application roller 29, and the toner images are fused on the recording medium 23 (S108).

The recording medium 23 on which the toner images are fused is guided by the selector 50 to the ejection carrying path 103, is ejected from an ejection port by the ejection roller unit 26, and is placed on the ejection tray 2 (S118). As a result, the formation of the toner images onto the transfer sheet is completed.

As described above, on the transfer sheet as the recording medium 23, the black, magenta, cyan, yellow and white toner images are sequentially formed. That is, the white toner image is formed above the color toner images.

Next, the case where the regular sheet is used as the recording medium 23 is described with reference to the flow diagram of FIG. 7.

S101 and S102 are the same as in the case where the transfer sheet is used. At S103, it is assumed that the user selects the "regular sheet" from the medium list 81 of the print mode setting screen 80, confirms the setting using the OK button 82, and stores the setting result.

As subsequent S104, the print controller 30 reads out the recording medium/print mode correspondence table illustrated in FIG. 5B from the ROM 35. Then, based on the correspondence table, the print controller 30 selects the two-pass print, in which a white toner image is formed below a color toner image (on the recording medium 23 side) (NO at S104), and proceeds to S109.

At S109, the above-described up-down controller 49 drives the up-down mechanism 70 and moves the up-down lever 71 to the position illustrated in FIG. 2A. As a result, as illustrated in FIG. 8A, the yellow, cyan, magenta and black ID units 10Y, 10C, 10M, 10K are spaced apart from the intermediate transfer belt 9 and only the white ID unit 10W is in contact with the intermediate transfer belt 9. Voltages are not applied to the respective rollers of the ID units 10Y, 10C, 10M, 10K.

At subsequent S110, a white toner image is formed by the ID unit 10W and is transferred to the intermediate transfer belt 9. That is, the belt drive roller 25*a* is rotationally driven by the drive motor D2 and the intermediate transfer belt 9 is driven at a speed of 130 mm/s so that a print speed for the regular sheet is 30 PPM.

The print controller 30 further drives the drum drive motor D1 to rotate the photosensitive drum 12*w*, the development roller 15*w* and the supply roller 17*w*. The charging roller 13*w* rotates following the rotation of the photosensitive drum 12*w*.

The print controller 30 reads out from the ROM 35 the voltage setting W2 for two-pass that is illustrated in FIG. 6, and instructs the charging voltage controller 43*b*, the development voltage controller 41*b*, the layer formation and the supply voltage controller 42*b* and the primary transfer controller 46, of the ID unit 10W, regarding respective set voltages.

The charging voltage CH of −1000 V is applied to the charging roller 13*w* by the charging voltage controller 43*b*. The charging roller 13*w* rotates while in contact with the photosensitive drum 12*w* and uniformly charges the surface of the photosensitive drum 12*w*.

When the surface of the photosensitive drum 12*w* is charged, the print controller 30, via the exposure controller 44*w*, causes the LED 14*w* to radiate light and, on the surface of the photosensitive drum 12*w*, an electrostatic latent image based on white image data is formed.

The development voltage DB of −200 V is applied to the development roller 15*w* by the development voltage controller 41*b*. The layer formation and supply voltage SB of −400 V is applied to each of the layer forming blade 16*w* and the supply roller 17*w* by the layer formation and supply voltage controller 42*b*. The supply roller 17*w* supplies toner to the surface of the development roller 15*w*. A layer thickness of the toner supplied on the surface of the development roller 15*w* is regulated due to passing through the layer forming blade 16*w*, and a toner layer having a uniform thickness is formed. The toner on the development roller 15*w* attaches the electrostatic latent image on the photosensitive drum 12*w* and thereby the electrostatic latent image is developed.

The primary transfer voltage TR of +4 kV is applied to the primary transfer roller 19*w* by the primary transfer controller 45*b*. The white toner image that is formed on the surface of the photosensitive drum 12*w* is transferred to the surface of the intermediate transfer belt 9 by the primary transfer roller 19*w*. In this way, the white toner image is transferred to the intermediate transfer belt 9.

The intermediate transfer belt 9 to which the white toner image has been transferred further moves due to the rotation of the drive roller 25*a*. However, since the ID units 10Y, 10C, 10M, 10K are spaced apart from the intermediate transfer belt 9, the yellow, cyan, magenta and black toner images are not transferred to the intermediate transfer belt 9. Then, the white toner image reaches the secondary transfer part (the secondary transfer backup roller 27*a* and the secondary transfer roller 27*b*).

The secondary transfer voltage of +4 kV is applied to the secondary transfer roller 27*b* by the secondary transfer controller 46. Further, at a timing same as the timing at which the toner image on the intermediate transfer belt 9 reaches the secondary transfer part, the recording medium 23 that is carried by the carrying roller unit 22 reaches the secondary transfer part.

The recording medium 23 passes through the secondary transfer part and thereby the white toner image on the intermediate transfer belt 9 is transferred to the recording medium 23 (S111).

The recording medium 23 to which the toner image has been transferred is carried to the fuser unit 24 due to the rotation of the secondary transfer roller 27*b*. The heat application roller 28 of the fuser unit 24 is heated to 160° C. in advance by the fuser controller 48 based on the temperature setting table. The recording medium 23 is heated and pressed by being sandwiched by the heat application roller 28 and the pressure application roller 29, and the toner image is fused on the recording medium 23 (S112).

Next, re-carrying of the recording medium 23 is performed (S113). That is, the print controller 30, via the switch controller 50, switches the position of the selector 50 to guide the recording medium 23 on which the toner image has been fused to the re-carrying path 104. Further, by the re-carrying roller 52 of the re-carrying unit 51, the recording medium 23 is carried along the re-carrying path 104 to the carrying roller 22. On the same surface of the recording medium 23 on which the white toner image is fused, color toner images are continuously formed. Therefore, the re-carrying unit 51 re-carries the recording medium 23 without inverting front and back sides of the recording medium 23.

At subsequent S114, the up-down controller 49 drives the up-down mechanism 70 and moves the up-down lever 71 to the position illustrated in FIG. 2B. As a result, as illustrated in FIG. 8B, the yellow, cyan, magenta and black ID units 10Y, 10C, 10M, 10K are in contact with the intermediate transfer belt 9 and the white ID unit 10W is spaced apart from the intermediate transfer belt 9. Voltages are not applied to the respective rollers of the ID unit 10W.

At subsequent S115, the ID units 10Y, 10C, 10M, 10K sequentially form the yellow, cyan, magenta and black toner images and transfer the toner images to the intermediate transfer belt 9.

That is, the belt drive roller 25*a* is rotationally driven by the belt drive motor D2 and the intermediate transfer belt 9 is driven at a speed of 130 mm/s so that a print speed is 30 PPM. The formation of the toner images by the ID units 10Y, 10C, 10M, 10K is performed in a manner same as the above-described S106.

In this way, the yellow, cyan, magenta and black toner images (that is, color toner images) are transferred to the intermediate transfer belt 9. Then, due to the rotation of the belt drive roller 25*a*, the intermediate transfer belt 9 further moves, and the toner images reach the secondary transfer part (the secondary transfer backup roller 27*a* and the secondary transfer roller 27*b*).

The secondary transfer voltage of +4 kV is applied to the secondary transfer roller 27*b* by the secondary transfer controller 46. Further, the print controller 30 causes the recording medium 23 that is carried via the re-carrying path 104 to reach the secondary transfer part at a timing same as the timing at which the toner images on the intermediate transfer belt 9 reach the secondary transfer part.

When the recording medium 23 passes through the secondary transfer part, the toner images on the intermediate transfer belt 9 are transferred to the recording medium 23 (S116).

As described above, the white ⊘ toner image has already been fused on the recording medium 23, and the yellow, cyan, magenta and black toner images are laminated in this order on the intermediate transfer belt 9. Therefore, at the secondary transfer part, when the toner images are transferred from the intermediate transfer belt 9 to the recording medium 23, the white, black, magenta, cyan and yellow toner images are sequentially laminated on the recording medium 23.

The recording medium 23 to which the toner image has been transferred is carried to the fuser unit 24 due to the rotation of the secondary transfer roller 27*b*. The heat application roller 28 of the fuser unit 24 is heated to 160° C. in advance by the fuser controller 48. The recording medium 23 is heated and pressed by being sandwiched by the heat application roller 28 and the pressure application roller 29, and the toner images are fused on the recording medium 23 (S117).

The recording medium 23 on which the toner images are fused is guided by the selector 50 to the ejection carrying path 103, is ejected from an ejection port by the ejection roller unit 26, and is placed on the ejection tray 2 (S118). As a result, the formation of the toner images onto the regular sheet is completed.

As described above, on the regular sheet as the recording medium 23, the white, black, magenta, cyan and yellow toner images are sequentially formed. That is, the white toner image is formed below the color toner images.

Figure 9A:
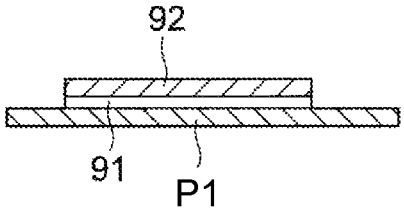
FIGS. 9A-9C illustrate schematic diagrams of a state in which a white toner image and a color toner image are printed on a regular sheet (FIG. 9A), a state in which a color toner image and a white toner image are printed on a transfer sheet (FIG. 9B), and a state in which the toner images of the transfer sheet are transferred to a T-shirt (FIG. 9C), in the first embodiment.
Figure 9B:
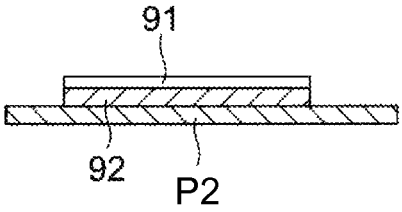

FIG. 9A illustrates a state in which a white toner image 91 and yellow, cyan, magenta and black toner images (color toner image) 92 are printed on a surface of a regular sheet P1 as the recording medium 23. FIG. 9B illustrates a state in which a color toner image 92 and a white toner image 91 are printed on a surface of a transfer sheet P2 as the recording medium 23.

As illustrated in FIG. 9A, on the regular sheet P1, the white toner image 91 is formed below the color toner image 92. Therefore, for example, even when a blue regular sheet P1 is used, since the white toner image 91 has a low light transmittance (it is opaque), influence of the color of the regular sheet P1 can be eliminated and the original color of the color toner image 92 can be reproduced.

Figure 9C:
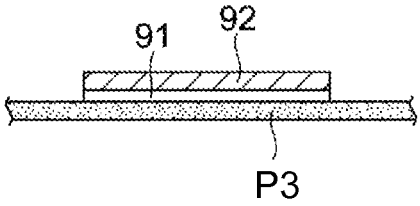

Further, as illustrated in FIG. 9B, on the transfer sheet P2, the white toner image 91 is formed above the color toner image 92. Therefore, as illustrated in FIG. 9C, when a user transfers the transfer sheet P2, for example, on a blue T-shirt P3, a white toner layer 91 is formed on the T-shirt P3 and a color toner image 92 (reverted image) is formed thereon. Therefore, without being influenced by the color of the T-shirt P3, the original color of the color toner image 92 can be reproduced.

In the present embodiment, since a white toner image can be formed on both a regular sheet and a transfer sheet, prior to forming a white toner image on a high cost transfer sheet, it is possible to form a white toner image on a regular sheet of a similar color and perform confirmation of the toner image (image). Therefore, it is possible to reduce cost.

<Operation of Image Forming Apparatus>

In the present embodiment, as illustrated in FIG. 6, the different voltage settings W1, W2 are provided for the one-pass print in which a white toner image is formed above a color toner image, and the two-pass print in which a white toner image is formed below a color toner image.

Specifically, during the one-pass print (W1) and during the two-pass print (W2), while a difference (800 V) between the development voltage and the charging voltage is the same and a difference (200 V) between the development voltage and the supply voltage is also the same, the development voltage (−260V, −200V) is different.

This is because, in the one-pass print in which a white toner image and color (yellow, cyan, magenta and black) toner images are continuously transferred to the intermediate transfer belt 9, when the white toner image that has been transferred to the intermediate transfer belt 9 passes through the color ID units 10Y, 10C, 10M, 10K, there is a possibility that the white toner on the intermediate transfer belt 9 is reversely transferred to the photosensitive drums 12*y*, 12*c*, 12*m*, 12*k*.

The "continuously transferred" means that one toner image is formed by one image forming unit on a transfer medium, next, another toner image is formed directly on the one toner image by another image forming unit before the one toner image is transferred to another medium or fused on the medium.

In particular, a white toner is generally a metal based pigment and thus is relatively difficult to be charged as compared to an organic material based pigment such as a color toner. Therefore, the white toner has a relatively weak adhering force with respect to the intermediate transfer belt 9 and reverse transfer of the white toner to the photosensitive drums 12*y*, 12*c*, 12*m*, 12*k* is likely to occur. When such reverse transfer occurs, an amount of the white toner on the intermediate transfer belt 9 decreases and as a result, there is a possibility that an amount of the white toner transferred to the recording medium 23 also decreases.

Therefore, in the present embodiment, in the one-pass print in which a white toner image and a color toner image are continuously transferred, the absolute value of the development voltage is set larger than that in the two-pass print in which a color toner image is transferred after a white toner image is fused. By increasing the absolute value of the development voltage, an adhesion amount of the white toner on the photosensitive drum 12*w* increases and the amount of the white toner transferred to the intermediate transfer belt 9 increases. As a result, even taking into account the decrease due to the reverse transfer of the white toner from the intermediate transfer belt 9 to the photosensitive drum 12*y* and the like, a sufficient amount of the white toner can remain on the intermediate transfer belt 9.

Next, difference in brightness of a toner density in a case where the development voltage is changed is described. For example, assume that a white toner of 0.80 mg/cm$^2$ is held on the surface of the photosensitive drum 12*w*, and assume that the white toner is primarily transferred from the photosensitive drum 12*w* to the intermediate transfer belt 9 and further secondarily transferred to a regular sheet ("color high-quality paper (blue)" manufactured by Kishu Paper Co., Ltd.). In a case where it is assumed that the reverse transfer of the white toner does not occur (that is, the case where the ID units 10Y, 10C, 10M, 10K are spaced part from the intermediate transfer roller 9), brightness on the regular sheet is L*83. This brightness (L*83) is a sufficient brightness.

However, since the toner moves to the photosensitive drum 12*w* from the development roller 15*w*, it is necessary to consider development efficiency and a linear speed ratio between the photosensitive drum 12*w* and the development roller 15*w*. The development efficiency indicates a percentage of the toner amount moved from the development roller 15*w* to the photosensitive drum 12*w*.

The white toner amount on the photosensitive drum 12*w* when a sufficient brightness (L*83) is obtained in the case where there is no decrease in the white toner amount due to the reverse transfer is 0.80 mg/cm$^2$ as described above. When the linear speed ratio between the development roller 15*w* and the photosensitive drum 12*w* is 1.2 times, in order to obtain a white toner amount of 0.80 mg/cm$^2$ on the photosensitive drum 12*w*, it is sufficient to have a white toner of 0.66 mg/cm$^2$ (=0.80 mg/cm$^2$±1.2) on the development roller 15*w*.

Therefore, even when the development efficiency is 80%, when there is a white toner of 0.83 mg/cm$^2$ on the development roller 15*w*, a white toner of 0.80 mg/cm$^2$ (≈0.83 mg/cm$^2$×1.2×0.8) on the photosensitive drum 12*w* can be obtained. In other words, in the case where the reverse transfer does not occur, even when the development efficiency is 80%, when there is a white toner of 0.83 mg/cm$^2$ on the development roller 15*w*, a sufficient brightness (L*83) can be obtained.

On the other hand, assuming the decrease in the white toner amount due to the reverse transfer is 0.20 mg/cm$^2$, a white toner of 0.80 mg/cm$^2$ 0.20 mg/cm$^2$=1.00 mg/cm$^2$ on the surface of the photosensitive drum 12*w* is required.

Therefore, in the present embodiment, in the print mode (one-pass print) in which the reverse transfer of the white toner occurs, the development voltage that is applied to the development roller 15*w* is changed from −200 V in the case of the two-pass print to −260 V. Since a surface potential of the photosensitive drum 12*w* after exposure is −50 V, a difference between this drum surface potential and the development voltage (development potential) is 150 V in the case of the two-pass print (development voltage: −200 V) and is 210 V in the case of the one-pass print (development voltage: −260 V). In this way, in the case of the one-pass print, by increasing the difference between the drum surface potential after exposure and the development voltage, the adhesion amount of the white toner onto the photosensitive drum 12*w* can be increased.

In this way, by increasing the adhesion amount of the white toner onto the photosensitive drum 12*w*, the white toner amount transferred to the intermediate transfer belt 9 can be increased. As a result, even when taking into account the decrease of the white toner due to the reverse transfer, sufficient white toner amount on the intermediate transfer belt 9 can be ensured. Therefore, sufficient brightness can be obtained.

Figure 10:
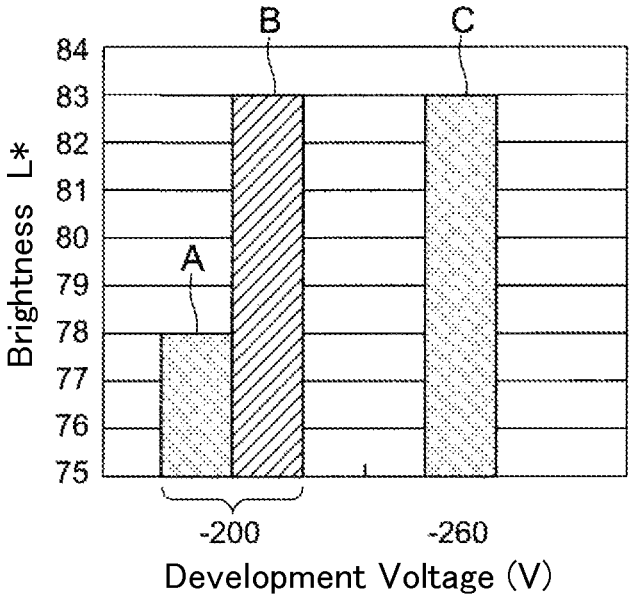
FIG. 10 illustrates a graph illustrating measurement results of brightness of toner images printed on a regular sheet by a one-pass print and a two-pass print.

FIG. 10 illustrates results obtained by performing the one-pass print and the two-pass print and measuring the brightness of the white toner images printed on blue regular sheets. Data A and data B illustrate the measurement results of the brightness of the white toner images in the case where the one-pass print and the two-pass print were performed by applying a voltage of −200 V to the development roller 15*w*. Data C illustrates the measurement result of the brightness of the white toner image in the case where the one-pass print was performed by changing the voltage applied to the development roller 15*w* to −260 V.

The brightness was measured using a "530 SpectroDensitometer" manufactured by X-Rite Incorporated. Further, as the regular sheet, the "color high-quality paper (blue)" manufactured by Kishu Paper Co., Ltd. is used.

As illustrated in FIG. 10, in the case where the development voltage was set to −200 V, while the brightness in the two-pass print was L*83 (data B), in the one-pass print, the brightness was L*78 (data A) and a decrease in density was observed. This is because in the one-pass print, the white toner image and the color toner images are continuously transferred and thus the above-described reverse transfer of the white toner occurs.

On the other hand, in the case where the one-pass print was performed by setting the development voltage to −260 V, the same brightness of L*83 as in the two-pass print was obtained (data C). By increasing the absolute value of the development voltage, the toner amount on the surface of the photosensitive drum 12*w* increased and the white toner amount that was transferred to the intermediate transfer belt 9 also increased, and thus, even when taking into account of the decrease in the toner amount due to the reverse transfer, a sufficient white toner amount could be ensured.

In this embodiment, in the case of the one-pass print, the adhesion amount of the white toner onto the photosensitive drum 12*w* is increased by increasing the absolute value of the development voltage to more than that in the case of the two-pass print. However, it is not limited to the development voltage. For example, it is also possible to increase the adhesion amount of the white toner onto the photosensitive drum 12*w* by increasing an exposure amount (light quantity) of the LED head 14*w*. In this case, for example, for a light quantity Lw of the LED head 14*w* in the case of the two-pass print, the light quantity of the LED head 14*w* in the case of the one-pass print may be set to 1.2×Lw. The light quantity of the LED head 14*w* can be controlled by, for example, a length of light emitting time of the LED head 14*w*. Further, it is also possible to combinedly change the development voltage and the exposure amount of the LED head.

Further, here, in the case of the two-pass print, as illustrated in FIGS. 8A and 8B, the ID units 10 are spaced apart from the intermediate transfer belt 9. However, the two-pass print may also be performed without having the ID units 10 spaced apart from the intermediate transfer belt 9. However, for example, in FIG. 8A, in a case where formation and transfer of a white toner image are performed without having the color ID units 10Y, 10C, 10M, 10K spaced apart from the intermediate transfer belt 9, since the photosensitive drums 12*y*, 12*c*, 12*m*, 12*k* of the ID units 10Y, 10C, 10M, 10K that do not perform image formation are also in contact with the intermediate transfer belt 9, it is necessary to rotate the respective rollers (the charging roller 13*y*-13*k*, the development roller 15*y*-15*k*, and the supply roller 17*y*-17*k*) of the ID units 10Y, 10C, 10M, 10K. As a result, in the ID units 10Y, 10C, 10M, 10K, in spite of that image formation is not performed, the photosensitive drums 12*y*, 12*c*, 12*m*, 12*k* and the development rollers 15*y*, 15*c*, 15*m*, 15*k* are in contact with each and further, the development rollers 15*y*, 15*c*, 15*m*, 15*k* and the layer forming blades 16*y*, 16*c*, 16*m*, 16*k* are in contact with each other, and thus there is a possibility that, due to wear at contact portions, lives of the ID units are shortened.

Figure 11A:
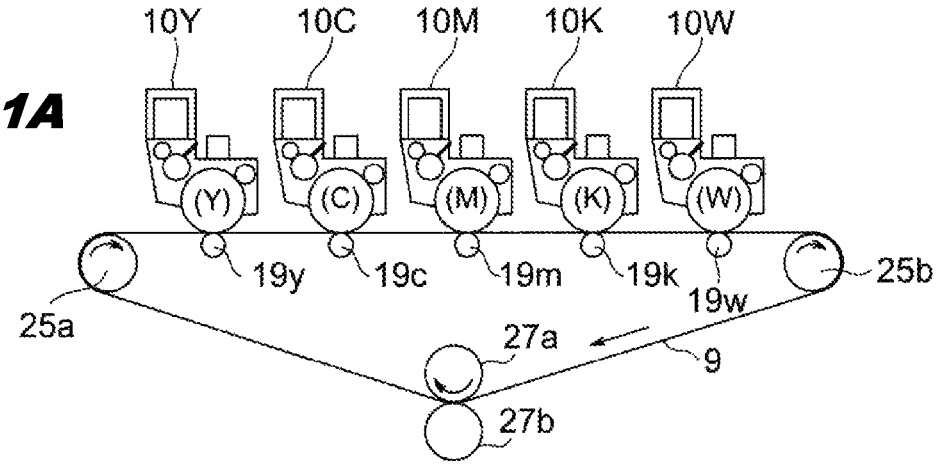
FIGS. 11A and 11B illustrate schematic diagrams for describing modified embodiments of the image forming apparatus of the first embodiment.

Further, in the image forming apparatus 1 of the present embodiment, the white, yellow, cyan, magenta and black ID units 10W, 10Y, 10C, 10M, 10K are arranged in a row along the movement direction (from left to right in FIG. 1) of the intermediate transfer belt 9. However, for example, as illustrated in FIG. 11A, the white ID unit 10W may also be arranged on the downstream side of the ID units 10Y, 10C, 10M, 10K in the movement direction of the intermediate transfer belt 9.

In this case, on the regular sheet, a toner image is formed by the one-pass print. That is, in a state in which the ID units 10Y, 10C, 10M, 10K, 10W are all in contact with the intermediate transfer belt 9, yellow, cyan, magenta, black and white toner images are primarily transferred to the intermediate transfer belt 9 and further secondarily transferred to the regular sheet and are fused thereon. As a result, on the regular sheet, the white toner image is formed and the color toner images are formed thereabove.

On the other hand, on the transfer sheet, a toner image is formed by the two-pass print. That is, by having the white ID unit 10W spaced apart from the intermediate transfer belt 9, yellow, cyan, magenta and black toner images are primarily transferred to the intermediate transfer belt 9 by the ID units 10Y, 10C, 10M, 10K and further secondarily transferred to the transfer sheet and are fused thereon. Subsequently, by having the ID units 10Y, 10C, 10M, 10K spaced apart from the intermediate transfer belt 9 and having the white ID unit 10W brought into contact with the intermediate transfer belt 9, a white toner image is primarily transferred to the intermediate transfer belt 9, and is secondarily transferred to the re-carried transfer sheet (on which the color toner images have been fused) and is fused thereon. As a result, on the transfer sheet, the color toner images are formed and the white toner image is formed thereabove.

Figure 11B:
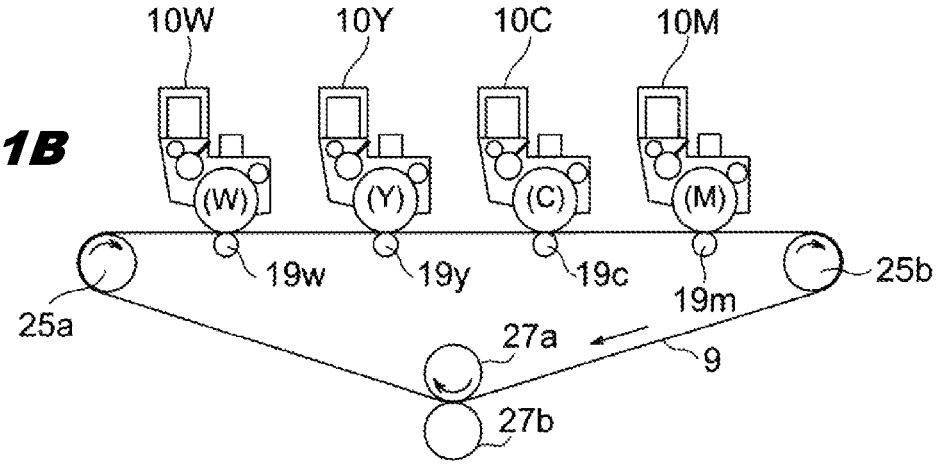

Further, in the image forming apparatus 1 of the present embodiment, the toners of five colors including white, yellow, cyan, magenta and black are used. However, it is also possible to use toners of four colors including white, cyan, yellow and magenta. In this case, for example, as illustrated in FIG. 11B, the white, yellow, cyan and magenta ID units 10W, 10Y, 10C, 10M may be arranged.

Further, in place of the white toner, a transparent toner for adjusting glossiness may be used. In this case, the ID unit that uses the transparent toner may be arranged, similar to the ID unit 10W illustrated in FIG. 1, on the upstream side of the color ID units 10Y, 10C, 10M, 10K, or, similar to the ID unit 10W illustrated in FIG. 11A, on the downstream side of the ID units 10Y, 10C, 10M, 10K.

Further, the ID unit that uses the white toner and the ID unit that uses the transparent toner may also be respectively arranged on the upstream and downstream sides of the color ID units 10Y, 10C, 10M, 10K.

Further, it is also possible to arrange the white (transparent) ID unit 10W between any adjacent two of the yellow, cyan, magenta and black ID units 10Y, 10C, 10M, 10K.

<Effects>

As described above, in the image forming apparatus 1 of the present embodiment, in the case of the one-pass print in which a white toner image (coating toner image) and a color toner image (image-forming toner image) are continuously transferred, the adhesion amount of the white toner onto the photosensitive drum 12*w* is increased to more than that in the case of the two-pass print. Therefore, even when the reverse transfer of the white toner from the intermediate transfer belt 9 to the photosensitive drum 12*y* and the like occurs, the white toner amount on the intermediate transfer belt 9 can be sufficiently ensured. Therefore, the white toner amount transferred to the recording medium 23 can be nearly constant and stable print quality can be obtained.

Further, by increasing the development voltage that is applied to the development roller 15*w* in the case of the one-pass print to more than that in the case of the two-pass print, increase in the adhesion amount of the white toner on the photosensitive drum 12*w* in the case of the one-pass print can be achieved. Further, instead of increasing the development voltage that is applied to the development roller 15*w*, increasing the exposure amount of the LED head 14*w* or increasing the supply voltage that is applied to the supply roller 17*w* can also achieve the effect.

Further, the image forming apparatus 1 of the present embodiment is provided with the up-down mechanism 70 that allows the white ID unit 10W and the color ID units 10Y, 10C, 10M, 10K to be selectively brought into contact with or spaced apart from the intermediate transfer belt 9. Therefore, switching between the one-pass print and the two-pass print can be easily performed.

Second Embodiment

Next, a second embodiment of the present invention is described. An image forming apparatus according to the present embodiment has the configuration illustrated in FIG. 1 but is different from the image forming apparatus of the first embodiment in that a process corresponding to a POP (Point of Purchase) mode is performed.

Figures 12, 13:
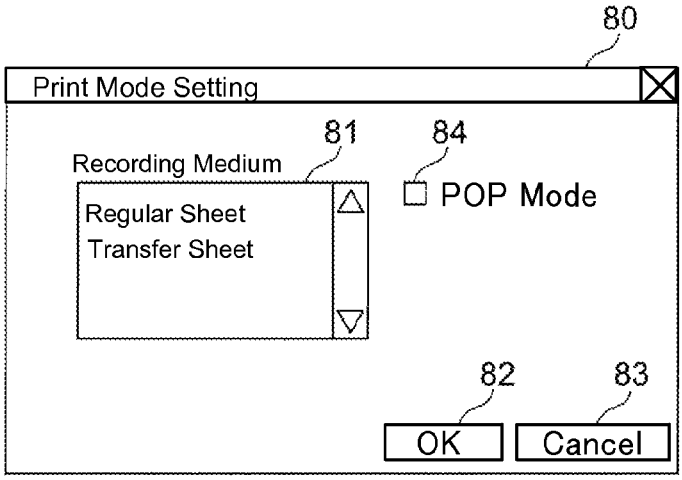
FIG. 12 illustrates a schematic diagram illustrating a print mode setting screen of an image forming apparatus according to a second embodiment of the present invention.
FIG. 13 illustrates a voltage setting table that is a list of setting values of charging voltages, development voltages, supply voltages and primary transfer voltages of respective ID units according to the second embodiment.

FIG. 12 illustrates a schematic diagram illustrating a print mode setting screen 80 of an image forming apparatus 1 according to the present embodiment. The print mode setting screen 80 of FIG. 12 is stored in the ROM 35 (FIG. 4).

The print mode setting screen 80 has a POP mode check box 84 (mode selection part) in addition to the medium list 81, the OK button 82 and the cancel button 83 that are described in the first embodiment. The POP mode is selected in a case where a high density pattern having an area ratio of 70% or more is printed.

When printing an image such as a POP advertisement having a higher image rate than a general document, there is a tendency that, when a normal amount of toner is supplied, the image is printed with a low toner density. Therefore, in the present embodiment, when the POP mode is selected, by increasing the difference between the development voltage and the supply voltage (supply/development voltage difference), the toner supply amount to the photosensitive drums is increased.

FIG. 13 illustrates a list (voltage setting table) of setting values of the charging voltages CH, the development voltages DB, the layer formation and supply voltages SB and the primary transfer voltages TR of the respective ID units 10W, 10Y, 10C, 10M, 10K according to the second embodiment. In the second embodiment, three voltage settings W1, W2, W3 are available for the white ID unit 10W. The voltage setting table is stored in the ROM 35.

Figure 14:
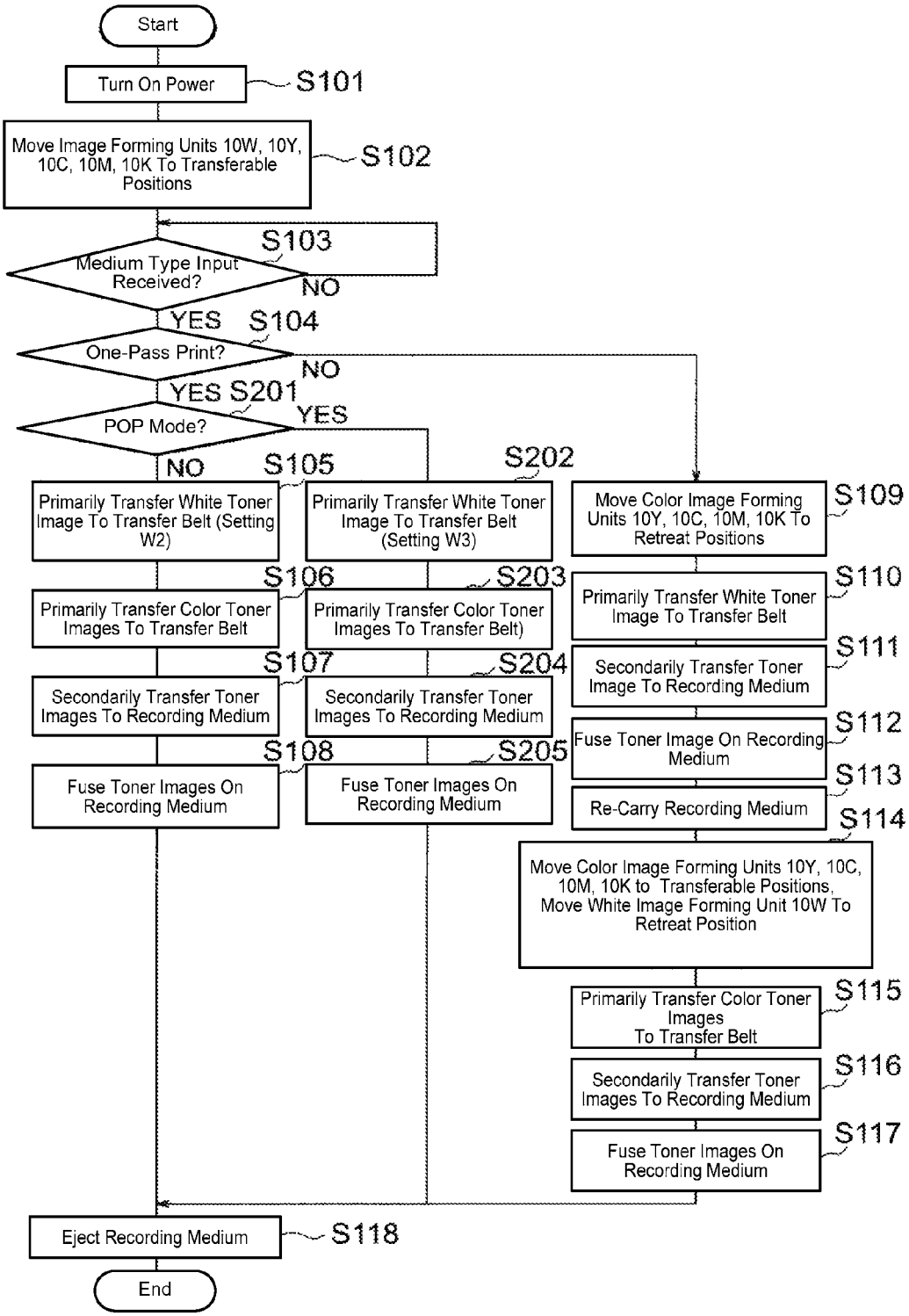
FIG. 14 illustrates a flow diagram illustrating operations of the image forming apparatus according to the second embodiment.

FIG. 14 illustrates a flow diagram illustrating operations of the image forming apparatus 1 according to the present embodiment. Here, differences from the first embodiment are described.

In the present embodiment, after power of the image forming apparatus 1 is turned on (S101) and the image forming units 10W, 10Y, 10C, 10M, 10K are moved to the transferable positions (S102), a user brings up, via the host device 31, the print mode setting screen 80 illustrated in FIG. 12 from the ROM 35.

In the print mode setting screen 80 illustrated in FIG. 12, the medium list 81 is used to receive input for the type of the recording medium 23 (regular sheet/transfer sheet) and the POP mode check box 84 is used to receive input regarding whether or not to perform printing in the POP mode (S103).

In the present embodiment, when the regular sheet print is selected in the mode setting screen 80, the image forming apparatus 1 operates in the same manner as in the first embodiment (S101-S104, S109-S118).

Here, it is assumed that the user selects the transfer sheet from the medium list 81 and further checks the POP mode check box 84 on the print mode setting screen 80, confirms the settings using the OK button 82, and stores the setting results.

When the transfer sheet is selected from the medium list 81 of the print mode setting screen 80, similar to the first embodiment, the print controller 30 brings up from the ROM 35 the recording medium/print mode correspondence table illustrated in FIG. 5B, selects the one-pass print (first print mode) based on the correspondence table, and proceeds to S201.

At S201, whether the POP mode in the print mode setting screen 80 is selected (that is, whether the POP mode check box 84 is checked) is judged. When the POP mode is not selected (NO at S201), printing on the transfer sheet is performed in the same manner as in the first embodiment (S105-S108, S118).

Here, as described above, the POP mode is selected (YES at S201) and thus the print controller 30 proceeds to S202.

At S202, a white toner image is transferred to the intermediate transfer belt 9 by the ID unit 10W. Here, the belt drive roller 25*a* is rotationally driven by the drive motor D2 and the intermediate transfer belt 9 is driven at a speed of 46 mm/s so that a print speed for the transfer sheet is 10 PPM.

The print controller 30 drives the drum drive motor D1 to rotate the photosensitive drum 12*w*, the development roller 15*w* and the supply roller 17*w*. The charging roller 13*w* rotates following the rotation of the photosensitive drum 12*w*.

The print controller 30 further reads out from the ROM 35 the POP mode voltage setting W3 of the voltage setting table that is illustrated in FIG. 13, and instructs the charging voltage controller 43*b*, the development voltage controller 41*b*, the layer formation and the supply voltage controller 42*b* and the primary transfer controller 46, of the ID unit 10W, regarding respective set voltages.

The charging voltage CH of −1060 V is applied to the charging roller 13*w* by the charging voltage controller 43*b*. The charging roller 13*w* rotates while in contact with the photosensitive drum 12*w* and uniformly charges the surface of the photosensitive drum 12*w*.

When the surface of the photosensitive drum 12*w* is charged, the print controller 30, via the exposure controller 44*w*, causes the LED 14*w* to radiate light and, on the surface of the photosensitive drum 12*w*, an electrostatic latent image based on white image data is formed.

The development voltage DB of −260 V is applied to the development roller 15*w* by the development voltage controller 41*b*. The layer formation and supply voltage SB of −500 V is applied to each of the layer forming blade 16*w* and the supply roller 17*w* by the layer formation and supply voltage controller 42*b*. The supply roller 17*w* supplies toner to the surface of the development roller 15*w*, and the toner supplied to the surface of the development roller 15*w* forms a toner layer having a uniform thickness due to passing through the layer forming blade 16*w*. The toner on the development roller 15*w* attaches the electrostatic latent image on the photosensitive drum 12*w* and thereby the electrostatic latent image is developed.

The primary transfer voltage TR of +4 kV is applied to the primary transfer roller 19*w* by the primary transfer controller 45*a*. The white toner image that is formed on the surface of the photosensitive drum 12*w* is transferred to the surface of the intermediate transfer belt 9 by the primary transfer roller 19*w*.

The intermediate transfer belt 9 further moves due to the rotation of the drive roller 25*a*, and the toner image on the intermediate transfer belt 9 moves to a downstream side.

At subsequent S203, the ID units 10Y, 10C, 10M, 10K sequentially form yellow, cyan, magenta and black toner images and transfer the toner images to the intermediate transfer belt 9 (S203).

The formation of the toner images by the ID units 10Y, 10C, 10M, 10K is substantially the same as the formation of the white toner image by the ID unit 10W. However, voltages of the respective rollers are set based on the voltage setting table of FIG. 13. That is, the charging voltage CH of −1200 V is applied to each of the charging rollers 13*y*, 13*c*, 13*m*, 13*k* by the charging voltage controller 43*a*, and the development voltage DB of −200 V is applied to each of the development rollers 15*y*, 15*c*, 15*m*, 15*k* by the development voltage controller 41*a*. Further, the layer formation and supply voltage SB of −300 V is applied to each of the layer forming blades 16*y*, 16*c*, 16*m*, 16*k* and the supply rollers 17*y*, 17*c*, 17*m*, 17*k* by the layer formation and supply voltage controller 42*b*. Further, the primary transfer voltage TR of +4 kV is applied to each of the primary transfer rollers 19*y*, 19*c*, 19*m*, 19*k* by the primary transfer controller 45*a*.

In this way, when the white, yellow, cyan, magenta and black toner images are formed on the intermediate transfer belt 9, the belt drive roller 25*a* further rotates and thereby, the intermediate transfer belt 9 further moves and, as described in the first embodiment, at the secondary transfer part (the secondary transfer backup roller 27*a* and the secondary transfer roller 27*b*), the toner images are transferred to the transfer sheet as the recording medium 23 (S204).

Thereafter, as described in the first embodiment, the toner images are fused on the recording medium 23 (S205), and thereafter, the recording medium 23 is ejected from the image forming apparatus 1 (S118).

In the present embodiment, different from the first embodiment, when the POP mode is selected, the supply/development voltage difference (difference between the supply voltage and the development voltage) is switched and is increased from −200 V of the case where the POP mode is not selected to −240 V. The reason for this is as follows.

In the POP mode, a high density pattern having an area ratio of 70% or more is printed. Therefore, there is a tendency that the toner transfer amount decreases from a leading edge toward a trailing edge of the recording medium 23.

Figure 15:
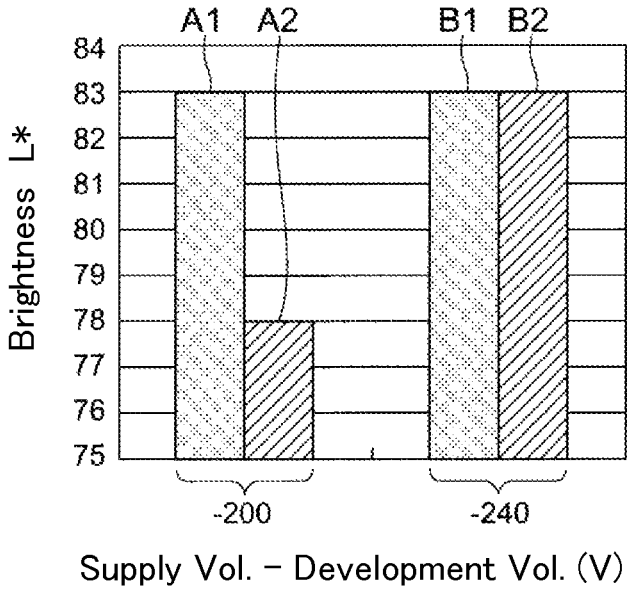
FIG. 15 illustrates a graph illustrating measurement results of brightness of a toner image at a leading edge and at a trailing edge of a recording medium.

FIG. 15 illustrates measurement results of the brightness at the leading edge and the trailing edge of the recording medium in a case where a solid image having an area rate of 100% was formed on the recording medium (transfer sheet). The brightness was measured using the "530 SpectroDensitometer" manufactured by X-Rite Incorporated.

Data A1 and data A2 in FIG. 15 illustrate measurement results of the brightness in a case where a voltage of −260 V is applied to the development roller 15*w* and a voltage of −460 V is applied to the supply roller 17*w* (therefore, the supply/development voltage difference is −200 V), and a solid image was formed by the one-pass print on the recording medium 23 (transfer sheet). The data A1 illustrates the measurement result of the brightness at the leading edge of the recording medium 23 in the movement direction and the data A2 illustrates the measurement result of the brightness at the trailing edge of the recording medium 23 in the movement direction.

Data B1 and data B2 in FIG. 15 illustrate measurement results of the brightness in a case where a voltage of −260 V is applied to the development roller 15*w* and a voltage of −500 V is applied to the supply roller 17*w* (therefore, the supply/development voltage difference is −240 V), and a solid image was formed by the one-pass print on the recording medium 23 (transfer sheet). The data B1 illustrates the measurement result of the brightness at the leading edge of the recording medium 23 in the movement direction and the data B2 illustrates the measurement result of the brightness at the trailing edge of the recording medium in the movement direction.

As illustrated in FIG. 15, in the where the voltage of −260 V was applied to the development roller 15*w* and the voltage of −460 V was applied to the supply roller 17*w*, the brightness at the leading edge of the recording medium was L*83 (data A1), but the brightness at the trailing edge dropped to L*78 (data A2). This is because, in the case of the one-pass print, as described in the first embodiment, along with increasing the voltage (development voltage) applied to the development roller 15*w* to increase the adhesion amount of the white toner on the photosensitive drum 12*w*, the toner supply from the supply roller 17*w* to the development roller 15*w* became insufficient.

In contrast, in the case where the voltage applied to the supply roller 17*w* was changed to −500 V while the voltage applied to the development roller 15*w* remained at −260 V, the supply/development voltage difference was −240 V. Therefore, the toner supply amount from the supply roller 17*w* to the development roller 15*w* increased and as a result, the brightness at the trailing edge of the sheet could be increased to L*83 (data B2).

As described in the first embodiment, a white toner of 0.83 mg/cm$^2$ is held on the development roller 15*w*.

The white toner amount on the photosensitive drum 12*w* when a sufficient brightness (L*83) is obtained in the case where there is no decrease in the white toner amount due to the reverse transfer is 0.80 mg/cm$^2$. When the linear speed ratio between the development roller 15*w* and the photosensitive drum 12*w* is 1.2 times, in order to obtain a white toner amount of 0.80 mg/cm$^2$ on the photosensitive drum 12*w*, it is sufficient to have a white toner of 0.66 mg/cm$^2$ (=0.80 mg/cm$^2$÷1.2) on the development roller 15*w*.

Therefore, when the reverse transfer does not occur, even when the development efficiency is 80%, when there is a white toner of 0.83 mg/cm$^2$ on the development roller 15*w*, a white toner of 0.80 mg/cm$^2$ (≈0.83 mg/cm$^2$×1.2×0.8) on the photosensitive drum 12*w* can be obtained.

On the other hand, assuming the decrease in the white toner amount due to the reverse transfer is 0.20 mg/cm$^2$, a white toner of 0.80 mg/cm$^2$ 0.20 mg/cm$^2$=1.00 mg/cm$^2$ on the surface of the photosensitive drum 12*w* is required.

Therefore, in the present embodiment, in the print mode in which the reverse transfer of the white toner occurs, by increasing the absolute value of the supply/development voltage difference from 200 V to 240 V, the white toner amount supplied from the supply roller 17*w* to the development roller 15*w* is increased to 1.04 mg/cm$^2$. As a result, a white toner of 1.00 mg/cm$^2$ (≈1.04 mg/cm$^2$×1.2×0.8) on the photosensitive drum 12*w* can be obtained. That is, even when the decrease due to the reverse transfer is taken into account, a sufficient white toner amount can be ensured and a density decrease at an edge of the recording medium 23 can be prevented.

Here, the example is described in which, when the POP printing is performed, the supply/development voltage difference is increased to increase the toner amount on the development roller 15*w*. However, the present invention is not limited to this, but can apply anything as far as the toner amount on the development roller 15*w* is increased when print data having a high area ratio is printed.

As described in the above, according to the second embodiment of the present invention, when print data having a high area ratio is printed, the supply/development voltage difference is increased to increase the toner on the development roller. Therefore, even for print data having a high area ratio, high quality print can be obtained.

In the above-described first and second embodiments, in the two-pass print, the intermediate transfer belt 9 passes twice through the image forming units 10W, 10Y, 10C, 10M, 10K. However, the intermediate transfer belt 9 may also pass three or more times through the image forming units 10W, 10Y, 10C, 10M, 10K.

In the above-described first and second embodiments, the image forming apparatus of an intermediate transfer system is described. However, the present invention may also be applied to an image forming apparatus of a direct transfer system. In the case of the direct transfer system, without using the intermediate transfer belt 9, the toner images of the ID units 10W, 10Y, 10C, 10M, 10K are directly transferred to the recording medium 23. Therefore, the recording medium 23 becomes a "transfer medium." Further, the present invention may also be applied to an image forming apparatus of a four-cycle system having a single image carrier. The recording medium as the transfer medium includes a transfer sheet that is disclosed in the first embodiment as an embodiment.

Further, the present invention is not limited to a printer, but can also be applied to various image forming apparatuses such as a copying machine, a facsimile, and an MFP (Multi Function Peripheral).

What is claimed is:

1. An image forming apparatus comprising:

a first image forming unit that uses a first toner to form a first toner image and transfers the first toner image to a transfer medium that moves in a predetermined moving direction;

a second image forming unit that is arranged on a downstream side from the first image forming unit in the movement direction of the transfer medium, uses a second toner to form a second toner image, and transfers the second toner image to the transfer medium; the second toner being characterized to be charged easier than the first toner is, a controller that controls the first image forming unit and the second image forming unit so that the first toner image and second toner image are layered on the transfer medium; the controller having two control modes;

a first print mode in which the first toner image and the second toner image are continuously transferred to the transfer medium by the first image forming unit and the second image forming unit so that the second toner image is formed on the first toner image above the transfer medium; and a second print mode that includes an operation in which the first toner image is transferred to the transfer medium by the first image forming unit and thereafter, the transfer medium, on which the first toner image is formed, is passed through the second image forming unit without the second image forming unit performing image transfer, wherein the controller performs control in such a manner that an amount of the first toner that is transferred from the first image forming unit in the first print mode is greater than that in the second print mode.

2. The image forming apparatus according to claim 1, wherein in the first print mode, by carrying only once the transfer medium along the first image forming unit and the second image forming unit, the first toner image and the second toner image are transferred to the transfer medium, and in the second print mode, by carrying at least twice the transfer medium along the first image forming unit and the second image forming unit, the first toner image and the second toner image are transferred to the transfer medium.

3. The image forming apparatus according to claim 1, wherein the first image forming unit comprises a first image carrier;

a first exposure part that exposes the first image carrier to form an electrostatic latent image;

a first developer carrier that develops the electrostatic latent image by using a first developer that contains the first toner; and a first supply member that supplies the first developer to the first developer carrier, and the second image forming unit comprises a second image carrier;

a second exposure part that exposes the second image carrier to form an electrostatic latent image;

a second developer carrier that develops the electrostatic latent image by using the second developer that contains the second toner; and a second supply member that supplies the second developer to the second developer carrier.

4. The image forming apparatus according to claim 1, wherein the controller applies development voltages to the first developer carrier and the second developer carrier, and the development voltage applied to the first developer carrier in the first print mode is greater than that in the second print mode.

5. The image forming apparatus according to claim 4, wherein a difference of the development voltages applied in the first and second print modes is at least 15 V.

6. The image forming apparatus according to claim 3, wherein the controller controls exposure amounts of the first and second exposure parts in the first and second print modes, and the exposure amount in the first print mode is greater than that is in the second print mode.

7. The image forming apparatus according to claim 3, wherein the controller controls supply voltages that are applied to the first and second supply members, and the supply voltage in the first print mode is greater than that in the second print mode.

8. The image forming apparatus according claim 7, wherein the controller applies the supply voltage that is 15V or more.

9. The image forming apparatus according to claim 3, further comprising:

a contact and separation mechanism that allows the first image carrier and the second image carrier to be respectively brought into contact with or spaced apart from the transfer medium.

10. The image forming apparatus according to claim 9, wherein the controller controls in such a manner that a toner amount on the first image carrier when the second image carrier is in contact with the transfer medium is more than a toner amount on the first image carrier when the second image carrier is spaced apart from the transfer medium.

11. The image forming apparatus according to claim 1, wherein the second toner image is an image-forming toner image that forms an image, and the first toner image is a coating toner image that is formed above or below the image-forming toner image.

12. The image forming apparatus according to claim 1, wherein the first toner is a white toner or a transparent toner.

13. The image forming apparatus according to claim 1, wherein the first toner is configured with a toner that contains an inorganic pigment or a toner that does not contain a pigment, and the second toner is configured with a toner that contains an organic pigment.

14. The image forming apparatus according to claim 1, further comprising a medium transfer part that transfers the first toner image and the second toner image from the transfer medium to a recording medium.

15. The image forming apparatus according to claim 1, wherein the second image forming unit includes a plurality image forming units that are configured to form a plurality of color toner images.

16. The image forming apparatus according to claim 1, wherein the controller has an input part to select one of the first print mode and the second print mode according to a type of a recording medium.

17. The image forming apparatus according to claim 1, wherein an average particle size of the first toner is greater than an average particle size of the second toner, and a difference between the first and second toners is at least 1.0 μm.

18. The image forming apparatus according to claim 14, wherein:

the transfer medium is an intermediate transfer belt that is an endless belt and rotates, and the intermediate transfer belt is arranged facing the first and second image forming units, also facing the medium transfer part, the first and second toner images formed on the intermediate transfer belt are to be further transferred to the recording medium that is carried along the medium transfer part.

19. The image forming apparatus according to claim 1, wherein:

the transfer medium is a recording medium that is carried to the first and second image forming units.

* * * * *